US008709691B2

(12) United States Patent
Matsuoka et al.

(10) Patent No.: US 8,709,691 B2
(45) Date of Patent: Apr. 29, 2014

(54) TONER FOR DEVELOPING ELECTROSTATIC CHARGE IMAGE, ELECTROSTATIC CHARGE IMAGE DEVELOPER, TONER CARTRIDGE, PROCESS CARTRIDGE, IMAGE FORMING METHOD, AND IMAGE FORMING APPARATUS

(75) Inventors: Hirotaka Matsuoka, Kanagawa (JP); Yuki Sasaki, Kanagawa (JP); Sumiaki Yamasaki, Kanagawa (JP); Satoshi Hiraoka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/584,379

(22) Filed: Aug. 13, 2012

(65) Prior Publication Data

US 2013/0071784 A1 Mar. 21, 2013

(30) Foreign Application Priority Data

Sep. 21, 2011 (JP) ..... 2011-206349

(51) Int. Cl.
*G03G 9/087* (2006.01)

(52) U.S. Cl.
USPC ..... 430/109.4; 399/252

(58) Field of Classification Search
USPC ..... 430/109.4; 399/252
See application file for complete search history.

(56) References Cited

U.S. PATENT DOCUMENTS

| | | | |
|---|---|---|---|
| 2008/0280219 A1 | 11/2008 | Nakayama et al. | |
| 2010/0099037 A1 | 4/2010 | McAneney-Lannen et al. | |

FOREIGN PATENT DOCUMENTS

| | | | | |
|---|---|---|---|---|
| JP | 60-170864 | * | 9/1985 | ..... G03G 9/08 |
| JP | A-9-281746 | | 10/1997 | |
| JP | A-2001-342244 | | 12/2001 | |
| JP | 2003-167384 | * | 6/2003 | ..... G03G 9/087 |
| JP | A-2006-195352 | | 7/2006 | |
| JP | A-2008-310280 | | 12/2008 | |
| JP | A-2009-14963 | | 1/2009 | |
| JP | A-2010-49070 | | 3/2010 | |
| JP | A-2010-102338 | | 5/2010 | |

OTHER PUBLICATIONS

Translation of JP 60-170864 published Sep. 1985.*
Translation of JP 2003-167384 published Jun. 2003.*

* cited by examiner

*Primary Examiner* — Peter Vajda
(74) *Attorney, Agent, or Firm* — Oliff PLC

(57) ABSTRACT

A toner for developing an electrostatic charge image includes an aliphatic polyester resin and a polyester resin having a repeating unit derived from rosin diol.

8 Claims, 2 Drawing Sheets

TONER FOR DEVELOPING ELECTROSTATIC CHARGE IMAGE, ELECTROSTATIC CHARGE IMAGE DEVELOPER, TONER CARTRIDGE, PROCESS CARTRIDGE, IMAGE FORMING METHOD, AND IMAGE FORMING APPARATUS

CROSS-REFERENCE TO RELATED APPLICATIONS

This application is based on and claims priority under 35 USC 119 from Japanese Patent Application No. 2011-206349 filed Sep. 21, 2011.

BACKGROUND

1. Technical Field

The present invention relates to a toner for developing an electrostatic charge image, an electrostatic charge image developer, a toner cartridge, a process cartridge, an image forming method, and an image forming apparatus.

2. Related Art

A method such as electrophotography in which image information is visualized through processes of for ng an electrostatic latent image and developing the electrostatic latent image, is currently being used in various fields. In this method, an image is formed by charging the entire surface of a photoreceptor (latent image holding member), exposing the surface of the photoreceptor to laser beams corresponding to image information to form an electrostatic latent image, developing the electrostatic latent image using a developer containing toner to form a toner image, and transferring and fixing the toner image onto the surface of a recording medium.

However, in recent years, in various office articles, articles for daily use, and the like, there has been a demand for manufacturing products with a material having less environmental impact, and recording media such as paper and various resins which are used as a binder resin of toner are no exception to this demand. In general, since resins are barely degraded in the natural environment, efforts toward reducing the environmental impact of resins have been made.

In general, polyester resin has been used as a binder resin of toner and among polyester resins, aliphatic polyester resin has been studied and put into practical use widely from the viewpoints of biodegradability and simple synthesis.

SUMMARY

According to an aspect of the invention, there is provided a toner for developing an electrostatic charge image including an aliphatic polyester resin and a polyester resin having a repeating unit derived from rosin diol.

BRIEF DESCRIPTION OF THE DRAWINGS

Exemplary embodiments of the present invention will be described in detail based on the following figures, wherein.

DETAILED DESCRIPTION

Figure 1:
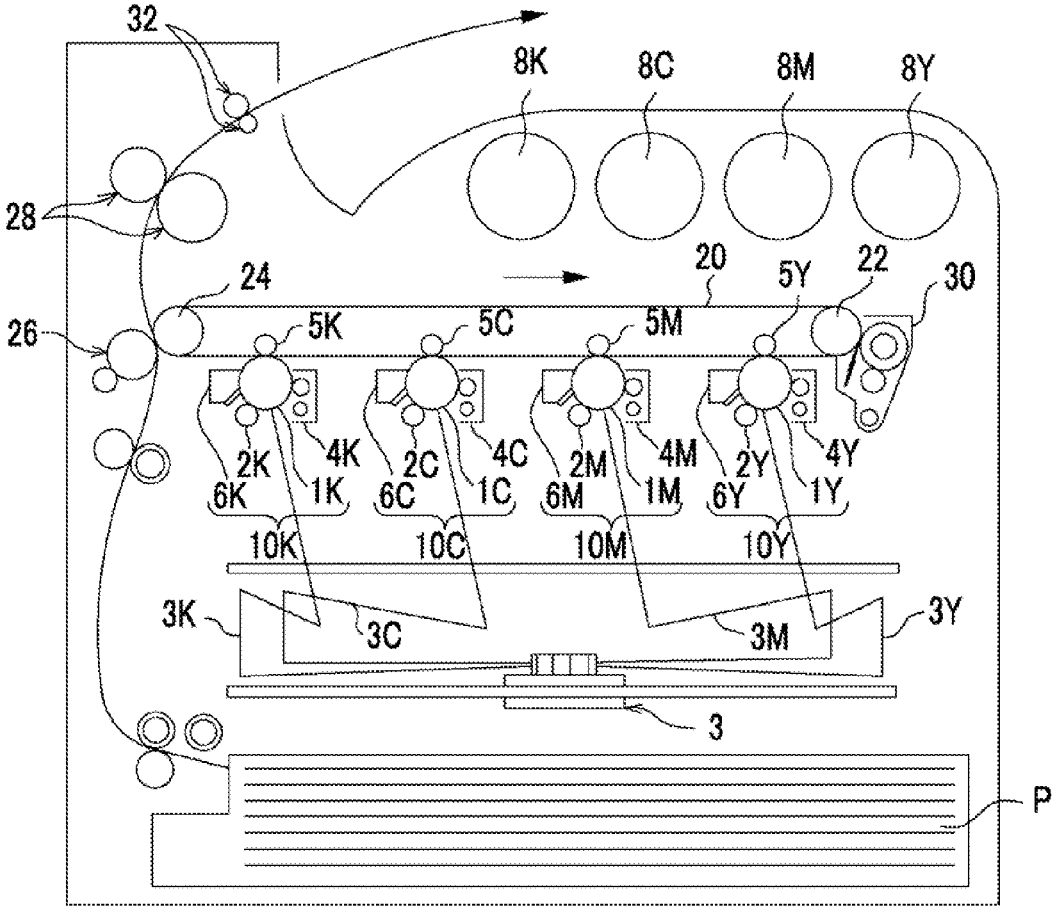
FIG. 1 is a diagram schematically illustrating a configuration example of an image forming apparatus according to an exemplary embodiment of the invention.

Hereinafter, a toner for developing an electrostatic charge image, an electrostatic charge image developer, a toner cartridge, a process, cartridge, an image forming method, and an image forming apparatus according to an exemplary embodiment of the invention will be described in detail.

In the following description, sometimes, the toner for developing an electrostatic charge image and the electrostatic charge image developer will be simply referred to as "the toner" and "the developer", respectively, Toner for Developing Electrostatic Charge Image The toner according to the exemplary embodiment includes an aliphatic polyester resin and a polyester resin having a repeating unit derived from rosin diol.

When the toner with the above-described configuration is used, the biodegradability of an aliphatic polyester resin does not deteriorate while the strength of a toner is maintained. The reason is not clear but considered to be as follows. In the following description, "the polyester resin having a repeating unit derived from rosin diol" will be sometimes referred to as "the specific rosin-based polyester resin".

Aliphatic polyester resin has biodegradability and less environmental impact. Specifically, for example, in a soil having a moisture content of 50% or greater, aliphatic polyester resin is easily hydrolyzed and degraded.

Therefore, by using aliphatic polyester resin as a binder resin of toner, a toner with less environmental impact has been expected to be produced. However, the biodegradability thereof causes toner to be thin and thus the strength of the toner is not maintained. On the other hand, in order to maintain the strength of the toner, when an aliphatic polyester resin with less hydrolyzability is used, the biodegradability of the aliphatic polyester resin deteriorates.

To that end, in the toner according to the exemplary embodiment, it is considered that, by using an aliphatic polyester resin and the specific rosin-based polyester resin together, the aliphatic polyester resin is covered with the specific rosin-based polyester resin. Since rosin has hydrophobicity and rigid mechanical strength, the specific rosin-based polyester resin having rosin as the molecular framework has also hydrophobicity and rigid mechanical properties. Therefore, it is considered that, even when the toner is held in a humid environment for storing toner or forming an image, by covering the aliphatic polyester resin with the specific rosin-based polyester resin, the aliphatic polyester resin is not easily exposed to moisture, and the hydrolysis of the aliphatic polyester resin is easily hindered and barely progresses. In addition, it is considered that the mechanical strength of rosin supplements the strength of the aliphatic polyester resin.

As a result, it is considered that the strength (dynamic strength) of the toner is maintained.

On the other hand, it is considered that, since the aliphatic polyester resin used for the toner according to the exemplary embodiment is not a resin with less hydrolyzability, the biodegradability of the aliphatic polyester resin does not easily deteriorate; and since the specific rosin-based polyester resin has rosin derived from a natural compound such as pine resin as the molecular framework, it easily biodegrades in soil.

As described above, according to the toner according to the exemplary embodiment, it is considered that the biodegradability of the aliphatic polyester resin does not deteriorate while the strength of the toner is maintained.

Hereinafter, the aliphatic polyester resin and the polyester resin having a repeating unit derived from rosin diol (the specific rosin-based polyester resin), which are included in the toner according to the exemplary embodiment, will be described.

Aliphatic Polyester Resin

The aliphatic polyester resin is a resin containing an aliphatic carboxylic acid ester as a repeating unit, and examples thereof include a hydroxycarboxylic acid copolymer and a copolymer of an aliphatic dial and an aliphatic carboxylic acid. An aliphatic hydrocarbon included in the aliphatic carboxylic acid ester may be a saturated or an unsaturated hydrocarbon and may have a linear, branched, or ring structure.

Furthermore, it is preferable that the aliphatic polyester resin have a repeating unit represented by Formula (I).

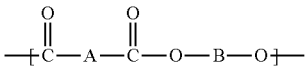

(I)

In Formula (I), A represents a single bond or a divalent aliphatic hydrocarbon group and B represents a divalent aliphatic hydrocarbon group having two or more carbon atoms. The sum of the numbers of carbon atoms of A and B is from 2 to 25.

When the aliphatic polyester resin has the repeating unit represented by Formula (I), the biodegradability of the aliphatic polyester resin may be improved and the molecular weight and the melting temperature may be increased. As a result, the aggregation (may be referred to as blocking) of toner particles is easily suppressed during image formation.

In Formula (I), A represents a single bond or a divalent aliphatic hydrocarbon group.

The aliphatic hydrocarbon group represented by A may be a saturated or unsaturated hydrocarbon group, and examples thereof include a linear or branched alkylene group, a cyclic alkylene group (that is, a cycloalkylene group), a linear or branched alkenylene group, and a cycloalkenylene group.

Among these, a linear or branched alkylene group or cycloalkylene group is preferable as the aliphatic hydrocarbon group.

Among these, it is preferable that A be a single bond, a linear or branched alkylene group, or a cycloalkylene group.

The number of carbon atoms of A is from 0 to 12, preferably from 1 to 10, and more preferably from 2 to 10. In this case, the fact that the number of carbon atoms of A is 0 means that A represents a single bond.

B represents a divalent aliphatic hydrocarbon group having two or more carbon atoms.

The aliphatic hydrocarbon group represented by B may be a saturated or unsaturated hydrocarbon group, and examples thereof include a linear or branched alkylene group, a cyclic alkylene group (that is, a cycloalkylene group) a linear or branched alkenylene group, and a cycloalkenylene group.

Among these, a linear or branched alkylene group or a cycloalkylene group is preferable as the aliphatic hydrocarbon group.

The number of carbon atoms of B is from 2 to 14, preferably from 2 to 11, and more preferably from 2 to 10.

In addition, in the exemplary embodiment, the sum of the numbers of carbon atoms of A and B is from 2 to 25. When the sum of the numbers of carbon atoms of A and Bis greater than 25, the development of biodegradability is difficult. In addition, since the sum of the numbers of carbon atoms of A and B is equal to or greater than 2, the resin is stable as a compound.

The sum of the numbers of carbon atom of A and B is preferably from 4 to 14, more preferably from 4 to 10, and still more preferably from 4 to 8.

In Formula (I), the aliphatic hydrocarbon groups represented by A and B may have a substituent. When A and B represent a linear or branched alkylene group, the alkylene group may have a cycloalkyl group as the substituent. In this case, the sum of the numbers of carbon atoms including those of the substituent only needs to be in the preferable ranges of the numbers of carbon atoms of A and B.

In addition, when A and B represent a branched alkylene group, the branched chain may form a ring with the main chain of the aliphatic polyester resin. In this case, it is preferable that A and B only include carbon atoms and hydrogen atoms from the viewpoint of biodegrading to carbon dioxide and water.

It is preferable that the aliphatic polyester resin have 5% to 40% of the repeating unit represented by Formula (I) with respect to the entire aliphatic polyester resin.

In this case, "5% or greater with respect to the entire aliphatic polyester resin" means that the content of the repeating unit represented by Formula (I) is 5% or greater with respect to the total weight of the aliphatic polyester resin, and 5% or less of other repeating units may be included in the repeating unit represented by Formula (I) with respect to the total weight of the aliphatic polyester resin.

In addition, the aliphatic polyester resin may contain less than 40% (upper it) of a repeating unit other than the repeating unit represented by Formula (I), with respect to the total weight of the aliphatic polyester resin.

The aliphatic polyester resin is obtained by a polycondensation reaction or an ester exchange reaction using a dicarboxylic acid component represented by Formula (III) below and a diol component represented by Formula (IV) below as polycondensation monomers.

In this case, the dicarboxylic acid component is not limited to dicarboxylic acid and includes carboxylic acid derivatives such as anhydrides of dicarboxylic acid and esterified carboxylic acids.

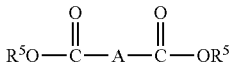

(III)

In Formula (III), $R^5$ represents a hydrogen atom, a lower alkyl group, or an aryl group and A represents a single bond or a divalent aliphatic hydrocarbon group.

(IV)

In Formula (IV), B represents a divalent aliphatic hydrocarbon group having two or more carbon atoms.

In Formulae (III) and (IV), the sum of carbon atoms of A and B is from 2 to 25.

Preferable examples of A and B in Formulae (III) and V) are the same as the examples of A and B in Formula (I).

In Formula (III), the lower alkyl group represented by $R^5$ represents an alkyl group having from 1 to 4 carbon atoms and may have a linear or branched structure. Examples thereof include a methyl group, an ethyl group, a propyl group, an isopropyl group, a butyl group, and a tert-butyl group.

In Formula (III), the aryl group represented by $R^5$ has preferably from 6 to 12 carbon atoms and more preferably from 6 to 10 carbon atoms.

The aryl group may have a substituent and examples thereof include a halogen atom and alkyl group having from 1 to 4 carbon atoms.

In addition, two $R^5$s in Formula (III) may be linked to each other to form a ring.

Examples of the dicarboxylic acid represented by Formula (III) include oxalic acid, malonic acid, succinic acid, glutaric acid, adipic acid, pimelic acid, suberic acid, azelaic acid, sebacic acid, nonanedicarboxylic acid, decanedicarboxylic acid, undecanedicarboxylic acid, tridecanedicarboxylic acid, β-methyladipic acid, fumaric acid, maleic acid, and citraconic acid (cis-HOOC—CH═C($CH_3$)—COOH).

In Formula (III), when A represents a cyclic alkylene group (cycloalkylene group), specific examples thereof include groups of cyclopropane, cyclobutane, cyclopentane, cyclohexane, cyclooctane, and cyclododecane from which two hydrogen atoms are excluded. Examples of a dicarboxylic acid in which A represents an cycloalkylene group include cyclohexanedicarboxylic acid, 1,1-cyclopentanedicarboxylic acid, and 1,2-cyclohexenedicarboxylic acid.

As described above, as the dicarboxylic acid, anhydrides and esterified acids of dicarboxylic acid may be used.

Examples of diol represented by Formula (IV) include ethylene glycol, propanediol, butanediol, pentanedial, hexanediol, heptanediol, octanediol, nonanediol, decanediol, undecanediol, dodecanediol, and tridecanediol.

In addition, when B in Formula (IV) represents a cyclic alkylene group, examples of dial having a cyclic structure include cyclohexanediol and cyclahexanedimethanol.

Particularly preferable examples of the dicarboxylic acid component represented by Formula (III) include oxalic acid, succinic acid, adipic acid, sebacic acid, and dodecanedioic acid.

Particularly preferable examples of the dial component represented by Formula (IV) include ethylene glycol, butanediol, hexanediol, actanediol, nonanediol, and decanediol.

Preferable examples of the combination of the dicarboxylic acid component and the dial component include combinations of the particularly preferable examples of the dicarboxylic acid component and the diol component. In the combination, the ranges of the numbers of carbon atoms of A in Formula (III) and B in Formula (IV) fall within the above-described ranges of the number of carbon atoms.

When the ranges of the numbers of carbon atoms of A in Formula (III) and B in Formula (IV) fall within the above-described ranges of the number of carbon atoms, three or more kinds of polycondensation monomers (repeating units) may be included. In this case, the respective average values of the numbers of carbon atoms in at least one of the dicarboxylic acid component and the diol component are calculated and based on the average values, whether or not the ranges of the numbers of carbon atoms of A in Formula (III) and B in Formula (IV) fall within the above-described ranges is determined.

As described above, the aliphatic polyester resin contain less than 40% (upper limit) of a repeating unit other than the repeating unit represented by Formula (I), with respect to the total weight of the aliphatic polyester resin.

Therefore, when three or more kinds of polycondensation monomers (repeating units) are included, the dicarboxylic acid component represented by Formula (III) and the diol component represented by Formula (IV) may be used in combination with another polycondensation monomer (repeating unit).

Examples of the polycondensation monomer which may be used in combination include polycarboxylic acid components, polyol components, and hydroxycarboxylic acid components. Among these, dicarboxylic acid components other than the dicarboxylic acid component represented by Formula (III), dial components other than the dial component represented by Formula (IV), or monohydroxy monocarboxylic acid components are preferable.

From the viewpoint of obtaining high biodegradability, it is preferable that the aliphatic polyester resin does not have a cross-linked structure. Therefore, it is preferable that, as the polycondensation monomer, trivalent or higher polyol components and trivalent or higher hydroxycarboxylic acid components be not used.

As described above, the carboxylic acid components include not only carboxylic acids but also carboxylic acid derivatives such as anhydrides and esterified acids thereof.

As described above, as another polycarboxylic acid component other than the dicarboxylic acid component represented by Formula (III), which may be used in combination with the dicarboxylic acid component represented by Formula (III) and the diol component represented by Formula (IV), dicarboxylic acid components are preferable and specific examples thereof as follows.

The dicarboxylic acid which may be used in combination as the polycondensation monomer is a compound having two carboxy groups in a molecule other than the dicarboxylic acid component represented by Formula (III), and examples thereof include phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediacetic acid, p-phenylenedipropionic acid, m-phenylenedipropionic acid, m-phenylenediglycollic acid, p-phenylenediglycollic acid, o-phenylenediglycollic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, and anthracenedicarboxylic acid.

In addition, examples of polycarboxylic acids other than dicarboxylic acids include trimellitic acid, pyromellitic acid, naphthalenetricarboxylic acid, naphthalenetetracarboxylic acid, pyrenetricarboxylic acid, and pyrenetetracarboxylic acid.

The above carboxylic acids may have a functional group other than a carboxyl group, and carboxylic acid derivatives such as anhydrides and acid esters may be used.

Another polyol other than the diol component represented by Formula (IV), which may be used in combination with the dicarboxylic acid component represented by Formula (III) and the diol component represented by Formula (IV), is a compound having two or more hydroxyl groups in a single molecule other than the diol component represented by Formula (IV). The polyol is not particularly limited but the following monomers may be used.

As diol, for example, octadecanediol may be used.

In addition, as polyol other than diol, for example, linear or branched polyol may be used and examples thereof include glycol, pentaerythritol, hexamethylolmelamine, hexaethylolmelamine, tetramethylolbenzoguanamine, and tetraethylolbenzoguanamine In addition, as polyol other than dial, for example, polyol having a cyclic structure may be used and examples thereof include bisphenol A, bisphenol C, bisphenol E, bisphenol F, bisphenol. P, bisphenol S, bisphenol Z, hydrogenated bisphenol, biphenol, naphthalenediol, and hydroxyphenyl cyclohexane. However, polyol other than dial is not limited to these examples.

It is preferable that the above-described bisphenols as polyols having a cyclic structure have at least one alkylene oxide group. Examples of the alkylene oxide group include an ethylene oxide group, a propylene oxide group, and a butylene oxide group. However, the alkylene oxide group is not limited to these examples. Among these, an ethylene oxide group or a propylene oxide group is preferable and it is preferable that the addition molar number of an alkylene oxide group be from 1 to 3. In the above range, the viscoelasticity and the glass transition temperature of the aliphatic polyester resin have a tendency to be in a preferable range when used for the toner.

As another polycondensation monomer which may be used in combination with the dicarboxylic acid component represented by Formula (III) and the dial component represented by Formula (IV), a hydroxycarboxylic acid compound having a carboxy group and a hydroxyl group in a single molecule may be used.

Examples of monohydroxy monocarboxylic acids include hydroxyoctanoic acid, hydroxynonanoic acid, hydroxydecanoic acid, hydroxyundecanoic acid, hydroxydodecanoic acid, hydroxytetradecanoic acid, hydroxytridecanoic acid, hydroxyhexadecanoic acid, hydroxypentadecanoic acid, and hydroxystearic acid. However, the monohydroxy monocarboxylic acid is not limited to these examples.

In addition, examples of trivalent or higher hydroxycarboxylic acids include malic acid (HOOC—CH(OH)—$CH_2$—COOH), tartaric acid (HOOC—CH(OH)—CH(OH)—COOH), mucic acid, dibutylol butanoic acid, and dibutylol propionic acid.

The aliphatic polyester resin may include a homopolymer in which one kind of the above-described dicarboxylic acid components and one kind of the above-described diol components are used; a copolymer in which two or more kinds of monomers including the above-described monomers are combined; or a mixture thereof or a graft polymer thereof, and may have a partially-branched or a cross-linked structure.

Weight Average Molecular Weight

The weight average molecular weight of the aliphatic polyester resin is preferably from 3,000 to 500,000.

When the weight average molecular weight is equal to or greater than 3,000, sufficient strength may be obtained, and when the weight average molecular weight is equal to or less than 500,000, biodegradability may not deteriorate.

The weight average molecular weight is preferably from 3,500 to 300,000, more preferably from 3,500 to 200,000, and still more preferably 3,500 to 100,000.

Melting Temperature

The melting temperature of the aliphatic polyester resin is preferably equal to or higher than 50° C., more preferably from 50° C. to 120° C., still more preferably from 60° C. to 110° C., and even still more preferably from 70° C. to 100° C.

When the melting temperature is equal to or higher than 50° C., the mechanical strength of the aliphatic polyester resin may increase.

In this case, the melting temperature of the aliphatic polyester resin is measured using a differential scanning calorimeter.

Preparation Method of Aliphatic Polyester Resin

The preparation method of the aliphatic polyester resin is not particularly limited, but it is preferable that the aliphatic polyester resin be prepared by the following method.

That is, the preparation method includes a process in which the dicarboxylic acid component represented by Formula (III) and the diol component represented by Formula (IV) are polycondensated in the presence of a polycondensation catalyst Polycondensation Catalyst As the polycondensation catalyst, for example, well-known polycondensation catalysts such as a metal catalyst or a hydrolase are used.

Examples of the metal catalyst include an organotin compound, an inorganic tin compound, an organotitanium compound, an organotin halide compound, and a rare earth metal catalyst. However, the metal catalyst is not limited to these examples.

As the organotin compound, the inorganic tin compound, the organotitanium compound, and the organotin halide compound, materials which are well-known as the polycondensation catalyst may be used.

As the rare earth metal catalyst, a catalyst including scandium (Sc) yttrium (Y), or lanthanoid (for example, lanthanum (La), cerium (Ce) praseodymium (Pr) neodymium (Nd) samarium (Sm), europium (Eu), gadolinium (Gd), terbium (Tb), dysprosium (Dy) holmium (Ho), erbium (Er), thulium (Tm), ytterbium (Yb), or lutetium (Lu)) is effective. In particular, a catalyst having alkylbenzene sulfonate, alkyl sulfate, or a triflate structure is effective.

As the rare earth metal catalyst, a catalyst having a triflate structure such as scandium triflate, yttrium triflate, or a lanthanoid triflate is preferable. Lanthanoid triflates are described in detail in Journal of Synthetic Organic Chemistry, Japan, vol. 53, No 5, p 44 to 54. For example, triflate is represented by a structural formula of $X(OSO_2CF_3)_3$. In the formula, X represents a rare earth metal element and it is preferable that X represents scandium (Sc), yttrium (Y), ytterbium (Yb), samarium (Sm) among rare earth metal elements.

When the metal catalyst is used as the polycondensation catalyst, the content of metal originating from the metal catalyst in the aliphatic polyester resin is preferably equal to or less than 10 ppm, more preferably equal to or less than 7.5 ppm, and still more preferably equal to or less than 5 ppm.

The hydrolase is not limited as long as it catalyzes an esterification.

Examples of the hydrolase include esterases, which are classified as EC (enzyme code) 3.1 (refer to "Enzyme Handbook", edited by Maruo and Tamiya, Asakura Shoten (1982)), such as carboxylesterase, lipase, phospholipase, acetylesterase, pectinesterase, cholesterol esterase, tannas, monoacylglycerol lipase, lactonase, and lipoprotein lipase; hydrolases, which are classified as EC 3.2 and act on a glycosyl compound, such as, glucosidase, galactosidase, glucuronidase, and xylosidase; hydrolases, which are classified as EC 3.3, such as epoxide hydrase; hydrolases, which are classified as EC 3.4 and act on a peptide bond, such as aminopeptidase chymotrypsin, trypsin, plasmin, and subtilisin; and hydrolases, which are classified as EC 3.7, such as phloretin hydrolase.

Among the esterases, enzymes which hydrolyze glycerol ester and liberate fatty acid are called lipases in particular. The lipase has advantages in that it is stable in an organic solvent, catalyzes an esterification with good yield, and is available at low cost. Therefore, when the aliphatic polyester resin is prepared, it is preferable that the lipase be used from the viewpoints of yield and cost.

The lipase is derived from various origins, but lipases derived from microorganisms such as Pseudomonas, Alcaligenes, Achromobacter, Candida, Aspergillus, Rhizopus, and Mucor; lipases derived from plant seeds; lipases derived from animal tissues; pancreatin; and steapsin are preferable. Among these, lipases derived from microorganisms of Pseudomonas, Candida, and Aspergillus are more preferable.

Examples of a basic catalyst include an organic basic compound, a nitrogen-containing basic compound, tetraalkyls such as tetrabutylphosphonium hydroxide, and arylphosphonium hydroxide. However, the basic catalyst is not limited to these examples.

Examples of the organic basic compound include ammonium hydroxides such as tetramethylammonium hydroxide, and tetraethylammonium hydroxide. Examples of the nitrogen-containing basic compound include amines (for example, triethylamine and, dibenzylmethylamine); pyridine; methylpyridine; methoxypyridine; quinoline; imidazole; hydroxides, hydrides, or amines of alkali metals (for example, sodium, potassium, lithium, and cesium) and alkaline earth metals (for example, calcium, magnesium, and barium); and salts of alkali and alkaline earth metal and an acid (for example, carbonates, phosphates, borates and carboxylates, or a salt pith a phenolic hydroxyl group).

In addition, for example, a compound with an alcoholic hydroxyl group and a chelate compound with acetylacetone may also be used, but the basic catalyst is not limited to these examples.

A polycondensation reaction in a polycondensation process is carried out by general polymerization methods such as aqueous polymerization (for example, bulk polymerization, emulsion polymerization, and suspension polymerization), solution polymerization, and interfacial polymerization. In addition, a polycondensation reaction may be carried out under atmospheric pressure. However, in order to increase the molecular weight of a polyester, general conditions such as reduction in pressure or under nitrogen gas stream may be used.

The aliphatic polyester resin may be obtained by polycondensation using another polycondensation monomer combination with the above-described components as long as the characteristics thereof are not impaired. Examples of another polycondensation monomer include a monovalent carboxylic acid, a monovalent alcohol, and a radical polymerizable monomer having an unsaturated bond. Since such a monofunctional monomer protects a polyester terminal, the terminal may be effectively modified and thus the characteristics of the polyester may be controlled. The monofunctional monomer may be used in the initial stage of polymerization or during polymerization.

The polycondensation process may include polymerization reaction of the above-described monomer and a prepolymer which is prepared in advance. The prepolymer is not limited as long as it may be melted or mixed with the above-described monomer.

Biodegradability

In the exemplary embodiment, "biodegradability" represents the aliphatic polyester resin being degraded by microorganisms or the like. The biodegradability of the aliphatic polyester resin may be evaluated in a method defined by JIS K 6950, JIS K 6951, JIS K 6953, JIS K 6955, ISO 14855-2, or OECD 301C.

In the exemplary embodiment, the biodegradability of the aliphatic polyester resin is examined through a process in which toner is molded into a 10 $cm^2$ plate having a thickness of 3 mm; the plate is buried in a relatively-high-humidity soil having a moisture content of 50% or greater, for example, in an unsunny soil (having a depth of 15 Cm from the surface); after 6 months and after 12 months from the burial, whether the original structure of the plate is maintained or not is determined by visual inspection. Further, the same process is performed in an example in which the plate is buried in a soil having lower humidity and a depth of 7 cm from the surface. As a result, whether or not the aliphatic polyester resin easily biodegrades in environments having different humidities is determined. In the soil having lower humidity and a depth of 7 cm from the surface, it is preferable that the original structure of the plate be not maintained.

Polyester Resin having Repeating Unit Derived from Rosin Diol (Specific Rosin-Based Polyester Resin)

The polyester resin having a repeating unit derived from rosin diol (specific rosin-based polyester resin) is a polyester resin having a repeating unit derived from a dicarboxylic acid component, a repeating unit derived from a diol component, and a repeating unit derived from rosin diol.

The dicarboxylic acid component and rosin diol constituting the respective repeating units of the specific rosin-based polyester resin are not particularly limited. As the dicarboxylic acid component, the dicarboxylic acids and dicarboxylic acid derivatives, which are described above as the dicarboxylic acid component used for the synthesis of the aliphatic polyester resin, may be used. In addition, rosin diol may be synthesized from, for example, rosin and an epoxy compound in a well-known method. Rosin is also called rosin acid because it is derived from a natural compound such as pine resin and has a carboxy group in general.

Examples of the specific rosin-based polyester resin include polyester resins having a repeating unit derived from the dicarboxylic acid component and a repeating unit derived from the diol component represented by Formula (1).

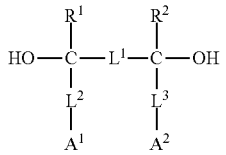

(1)

In Formula (1), $R^1$ and $R^2$ represent a hydrogen atom or a methyl group. $L^1$, $L^2$, and $L^3$ represent a carbonyl group, an ester group, an ether group, a sulfonyl group, a linear alkylene group, a branched alkylene group, a cyclic alkylene group, an arylene group or a divalent linking group selected from a group consisting of combinations of the above-described groups wherein $L^1$ and $L^2$ or $L^1$ and $L^3$ may form a ring together. $A^1$ and $A^2$ represent a rosin ester group.

The diol component represented by Formula (1) is a diol compound containing two rosin ester groups in a single molecule (hereinafter, sometimes referred to as the specific rosin diol). In Formula (1), $R^1$ and $R^2$ represent a hydrogen atom or a methyl group. $A^1$ and $A^2$ represent a rosin ester group. In the exemplary embodiment, the rosin ester group represents a residue in which a hydrogen atom is excluded from a carboxyl group included in rosin.

When rosin from which the rosin ester group included in the specific rosin diol is derived has a bulky structure and high hydrophobicity, the specific rosin-based polyester resin containing the rosin ester group is hydrophobic. In addition, in the structure of the polyester resin, there is a hydroxyl group or a carboxyl group only in a terminal of the resin molecules. Therefore, the amount of the rosin ester groups may be increased in the resin without increasing the amount of hydroxyl groups or carboxyl groups which may have an adverse effect on a charging property of toner. Furthermore, when the specific rosin diol is obtained by causing rosin and a bifunctional epoxy compound to react with each other, a ring-opening reaction of an epoxy group in the bifunctional epoxy compound and a carboxyl group in rosin is more reactive than an esterification of an alcohol component and rosin. Therefore, unreacted rosin barely remains in the specific rosin-based polyester resin.

Hereinafter, an example of a synthesis scheme of the specific rosin-based polyester resin is shown. In the synthesis scheme, the specific rosin diol is synthesized by causing the bifunctional epoxy compound and rosin to react with each other and the specific rosin-based polyester resin is synthesized by dehydration polycondensation of the synthesized specific rosin diol and the dicarboxylic acid component. In the following structural formula which represents the specific rosin-based polyester resin, a portion surrounded by a dotted line corresponds to the rosin ester group according to the exemplary embodiment.

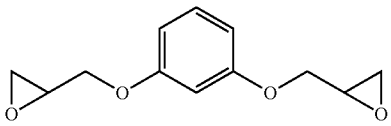

Epoxy Compound

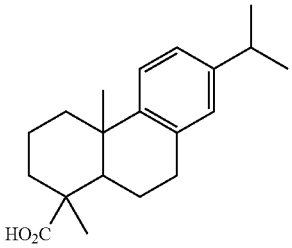

Rosin

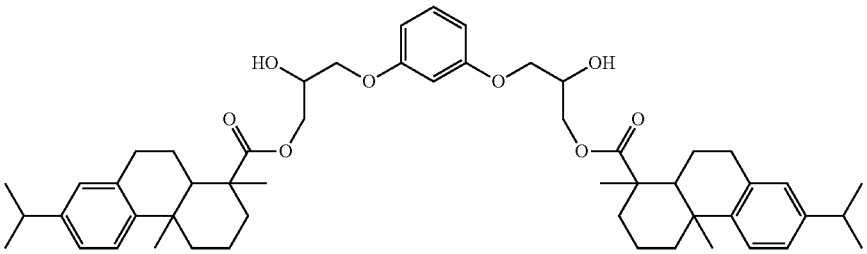

Rosin Diol

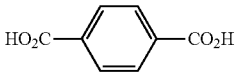

Dicarboxylic Acid

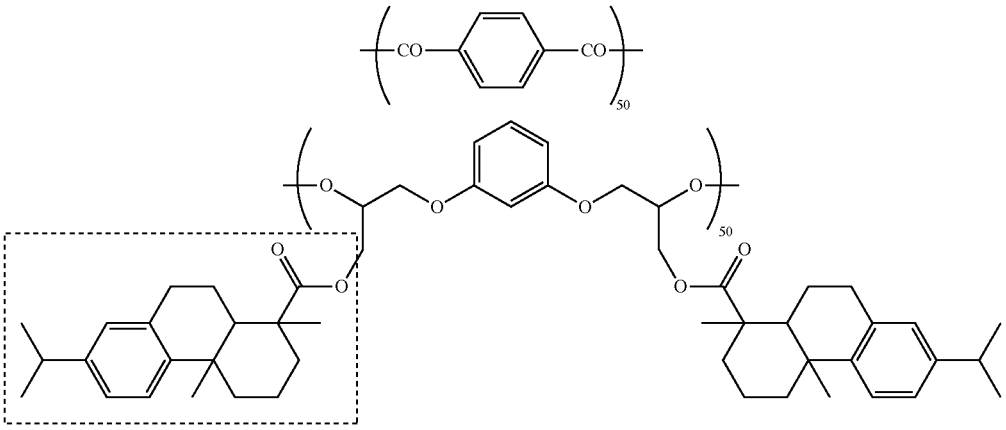

Polyester Resin

The specific rosin-based polyester resin is hydrolyzed the following monomers. Since the polyester resin is a condensate of dicarboxylic acid and diol with a mixing ratio of 1:1, the components of the resin may be estimated from hydrolysates.

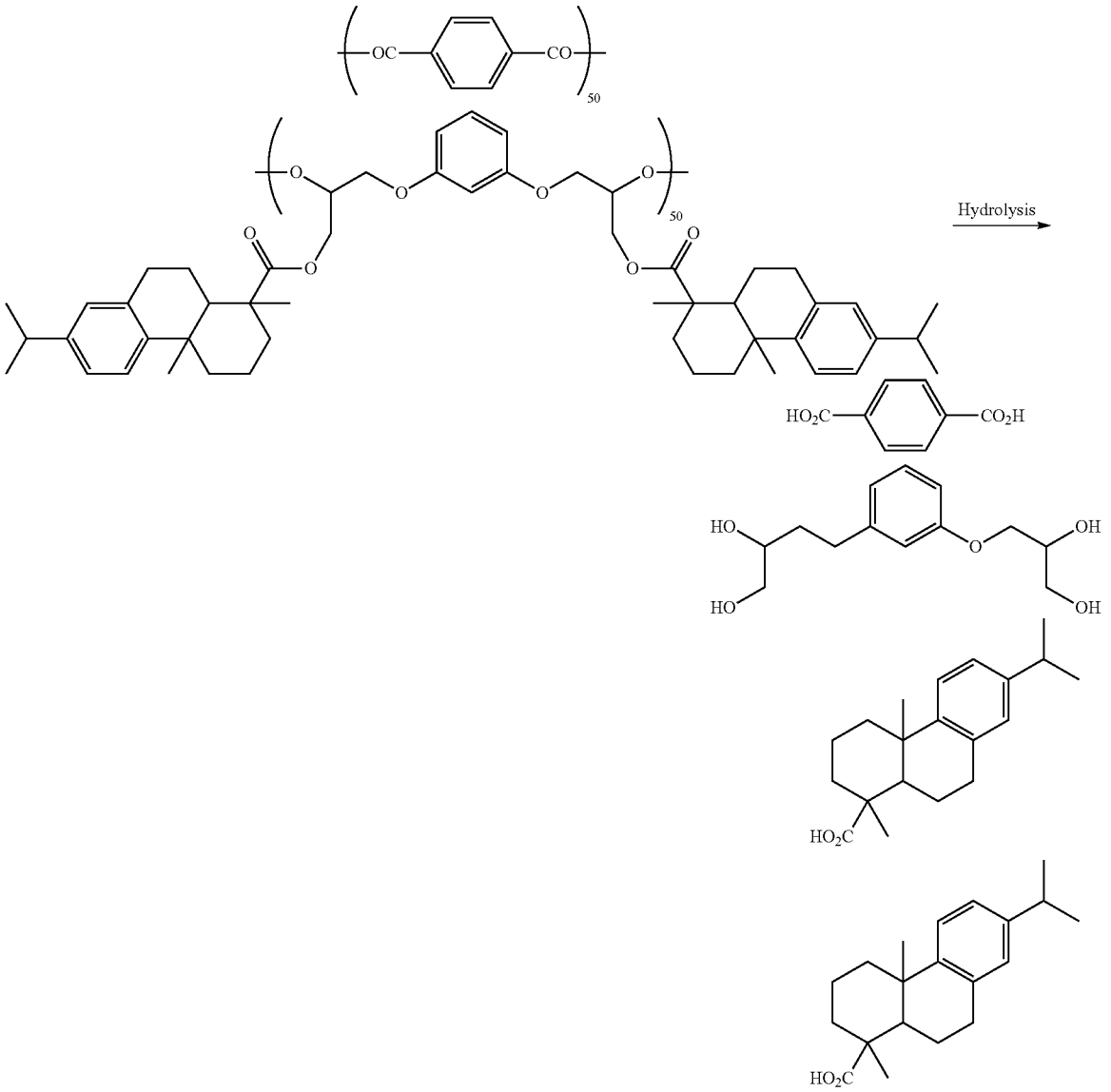

In Formula (1), $L^1$, $L^2$, and $L^3$ represent a carbonyl group, an ester group, an ether group, a sulfonyl group, a linear alkylene group, a branched alkylene group, a cyclic alkylene group, an arylene group or a divalent linking group selected from a group consisting of combinations of the above-described groups wherein $L^1$ and $L^2$ or $L^1$ and $L^3$ may form a ring together.

Examples of linear or branched alkylene groups represented by $L^1$, $L^2$, and $L^3$ include linear or branched alkylene groups having from 1 to 10 carbon atoms.

Examples of cyclic alkylene groups represented by $L^1$, $L^2$, and $L^3$ include cyclic alkylene groups having from 3 to 7 carbon atoms.

Examples of arylene groups represented by $L^1$, $L^2$, and $L^3$ include a phenylene group, a naphthylene group, and an anthracene group.

Examples of a substituent of the linear, branched, or cyclic alkylene groups and the arylene groups include an alkyl group having 1 to 8 carbon atoms and an aryl group, and a linear, branched, or cyclic alkyl group is preferable. Specific examples thereof include a methyl group, an ethyl group, a propyl group, a butyl group, a pentyl group, a hexyl group, a heptyl group, an octyl group, an isopropyl group, an isobutyl group, an s-butyl group, a t-butyl group, an isopentyl group, a neopentyl group, a 1-methylbutyl group, an isohexyl group, a 2-ethylhexyl group, a 2-methylhexyl group, a cyclopentyl group, a cyclohexyl group, and a phenyl group.

The specific rosin diol represented by Formula (1) may be synthesized by a well-known method and, for example, may be synthesized by a reaction of a bifunctional epoxy compound and rosin. An epoxy-group-containing compound which may be used in the exemplary embodiment is a bifunctional epoxy compound containing two epoxy groups in a single molecule, and examples thereof include diglycidyl ether of aromatic diol, diglycidyl ether of aromatic dicarboxylic acid, diglycidyl ether of aliphatic diol, diglycidyl ether of alicyclic diol, and alicyclic epoxide.

Representative examples of diglycidyl ether of aromatic diol include, as an aromatic diol component, bisphenol A and bisphenol A derivatives such as polyalkylene oxide adducts of bisphenol A; bisphenol F and bisphenol F derivatives such as polyalkylene oxide adducts of bisphenol F; bisphenol S and bisphenol S derivatives such as polyalkylene oxide adducts of bisphenol S; resorcinol; t-butylcatechol; and biphenol.

Representative examples of diglycidyl ether of aromatic dicarboxylic acid include, as an aromatic dicarboxylic acid component, terephthalic acid, isophthalic acid, and phthalic acid.

Representative examples of diglycidyl ether of aliphatic diol include, as an aliphatic diol component, ethylene glycol, 1,2-propanediol, 1,3-propanediol, 1,4-butanediol, 1,5-pentanediol, 1,6-hexanediol, neopentyl glycol, 1,9-nonanediol, diethylene glycol, triethylene glycol, polyethylene glycol, polypropylene glycol, and polytetramethylene glycol.

Representative examples of dglycidylether of alicyclic diol include, as an alicyclic diol component, hydrogenated bisphenol A, hydrogenated bisphenol A derivatives such as polyalkylene oxide adducts of hydrogenated bisphenol A, and cyclohexanedimethanol.

A representative example of alicyclic epoxide includes limonene dioxide.

The epoxy-group-containing compound is obtained by a reaction of a diol component and epihalohydrin, but, depending on the amount ratio thereof, may be a polymer obtained by polycondensation thereof.

In the exemplary embodiment, the reaction of rosin and the bifunctional epoxy compound proceeds through the ring-opening reaction of the carboxylic group of rosin and an epoxy group of the bifunctional epoxy compound. At this time, the reaction temperature is preferably equal to or higher than the melting temperatures of both components and/or is preferably a temperature at which both components may be mixed with less deviation, specifically, from 60° C. to 200° C. in general. During the reaction, a catalyst which promotes the ring-opening reaction of an epoxy group may be added.

Examples of the catalyst include amines such as ethylenediaamine, trimethylamine, and 2-methyl imidazole; quarternary ammonium salts such as triethylammonium bromide, triethylammonium chloride, and butyltrimethylammonium chloride; and triphenylphosphine.

The reaction may be carried out in various ways. For example, when a batch method is used, in general, rosin and the bifunctional epoxy compound are put, with a predetermined ratio, into a flask which has a heating function and is equipped with a cooling pipe, a stirring device, an inert gas inlet port, a thermometer, and the like, followed by heating and melting. Then, a reactant is sampled. The progress of the reaction is examined by checking the reduction in acid value, and the reaction is finished when it reaches or approaches the stoichiometric end point.

The reaction ratio of rosin and the bifunctional epoxy compound is not particularly limited. However, regarding the mole ratio of rosin and the bifunctional epoxy compound, it is preferable that 1.5 moles to 2.5 moles of rosin be reacted with 1 mole of the bifunctional epoxy compound.

Rosin used in the exemplary embodiment is a collective term of resin acids obtained from trees and the main component thereof is natural products including abietic acid, which is a kind of tricyclic diterpene, and isomers thereof. Specific examples of components of rosin include, in addition to abietic acid, palustric acid, neoabietic acid, pimaric acid, dehydroabietic acid, isopimaric acid, and sandaracopimaric acid. Rosin used in the exemplary embodiment is a mixture of the above materials.

When classified based on the collection method, rosins are broadly divided into three kinds of tall rosin made from pulp, gum rosin made from crude turpentine, and wood rosin made from pine stump. As rosin used in the exemplary embodiment, gum rosin and/or tall rosin is preferable from the viewpoint of availability.

It is preferable that these rosins be purified. From unpurified rosins, a polymer, which is considered to originate from a peroxide of a resin acid, or non-saponification matter, which is included in unpurified resins, is removed. As a result, purified rosin is obtained. The purification method is not particularly limited and well-known purification methods are used, for example. Specifically, distillation, recrystallization, extraction, and the like are used. Industrially, distillation is preferable for purification. In general, distillation conditions are selected from a temperature of 200° C. to 300° C. and at a pressure of 6.67 kPa or less in consideration of distillation time. Recrystallization is performed, for example, by dissolving unpurified rosin in a good solvent, removing the solvent by filtration to obtain a thick solution, and adding the thick solution to a poor solvent. Examples of the good solvent include aromatic hydrocarbons such as benzene, toluene, and xylene; chlorinated hydrocarbons such as chloroform; alcohols such as lower alcohols; ketones such as acetone; and acetic acid esters such as ethyl acetate. Examples of the poor solvent include hydrocarbon solvents such as n-hexane, n-heptane, cyclohexane, and isooctane. Extraction is a method of obtaining purified rosin by dissolving unpurified rosin in an aqueous alkali to obtain an aqueous alkali solution, extracting insoluble non-saponification matter from the aqueous alkali solution with an organic solvent, and neutralizing the water layer.

As rosin used in the exemplary embodiment, disproportionated rosin may be used. Disproportionated rosin is obtained by heating rosin including abietic acid as a main component at high temperature in the presence of a disproportionation catalyst to eliminate an unstable conjugated double bond in the molecule. The rain component thereof is a mixture of dehydroabietic acid and dihydroabietic acid.

Examples of the disproportionation catalyst include various well known catalysts, for example, supported catalysts such as palladium on carbon rhodium on carbon, and platinum on carbon; powders of metals such as nickel or platinum; and iodine and iodides such as iron iodide.

In addition, as rosin used in the exemplary embodiment, hydrogenated rosin may be used in order to eliminate an unstable conjugated double bond in the molecule. In a hydrogenation reaction, well-known hydrogenation reaction conditions may be appropriately selected. That is, rosin is heated in the presence of a hydrogenation catalyst under hydrogen pressure. Examples of the hydrogenation catalyst include various well-known catalysts, for example, supported catalysts such as palladium on carbon, rhodium on carbon, and platinum on carbon; powders of metals such as nickel or platinum; and iodine and iodides such as iron iodide.

During the preparation of the disproportionation rosin or the hydrogenated rosin, the above-described purification process may be provided before or after a disproportionation treatment or a hydrogenation treatment.

Hereinafter, exemplary compounds of the specific rosin diol which is preferably used in the exemplary embodiment are shown, but the specific rosin diol is not limited thereto.

(1)
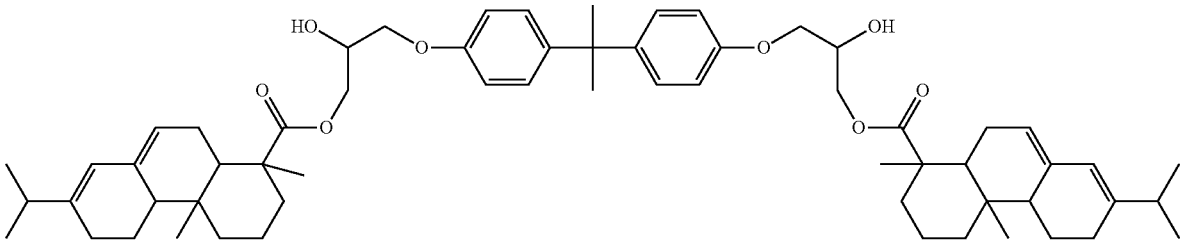
(2)
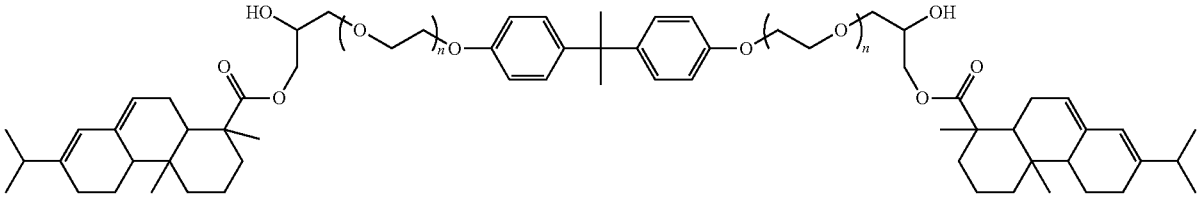
(3)
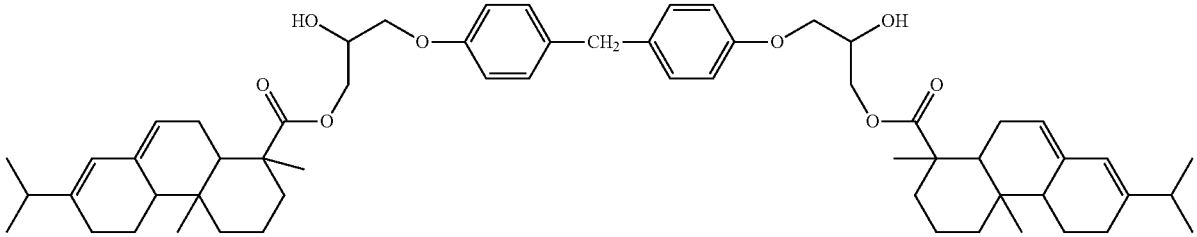
(4)
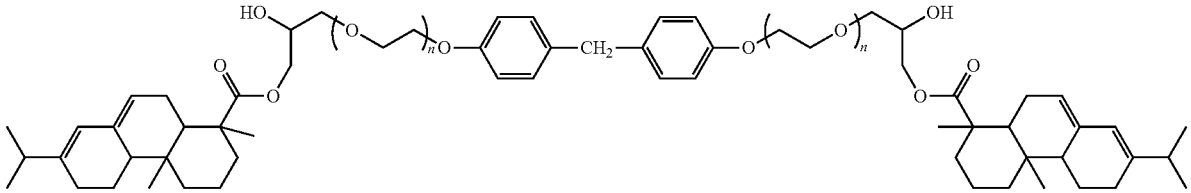
(5)
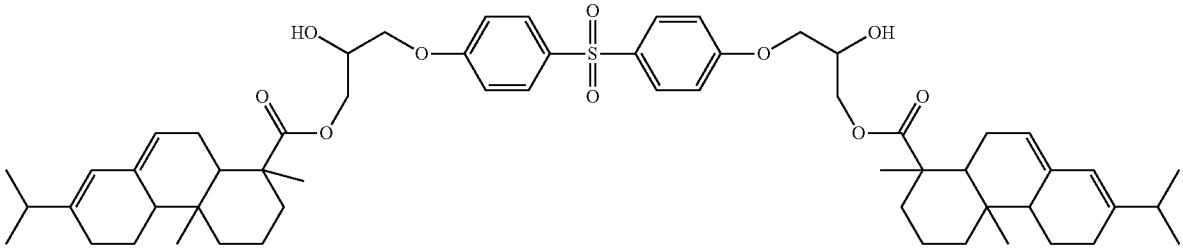
(6)
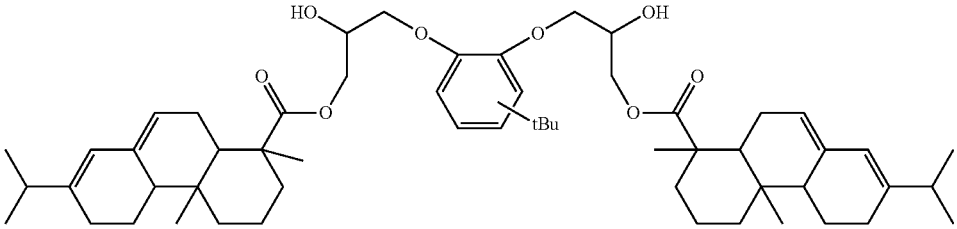

-continued
(7)
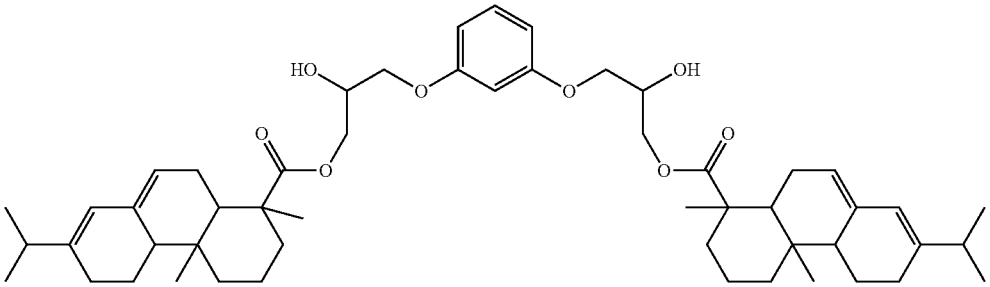
(8)
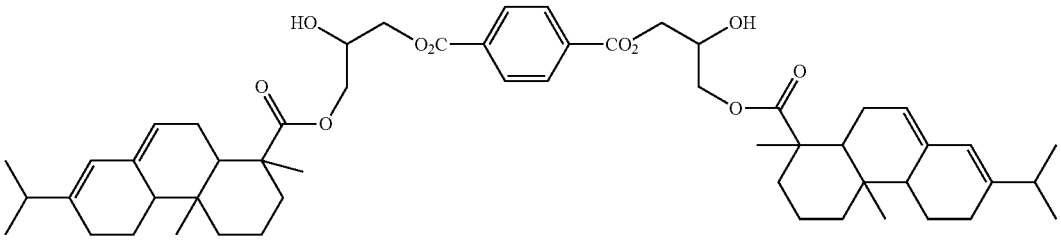
(9)
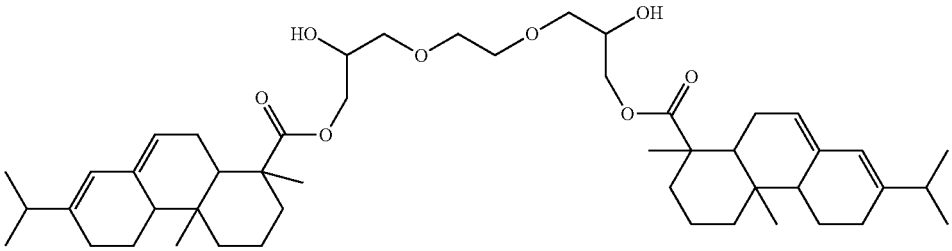
(10)
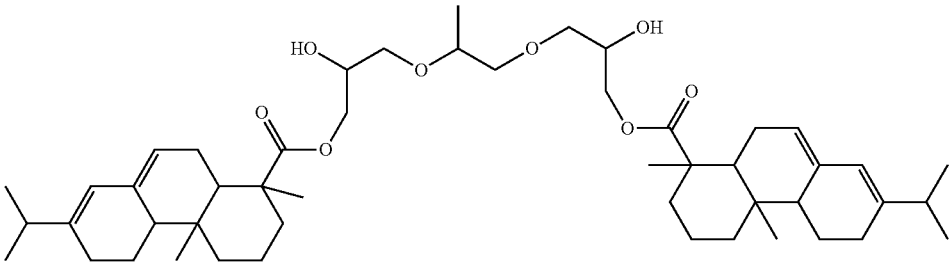
(12)
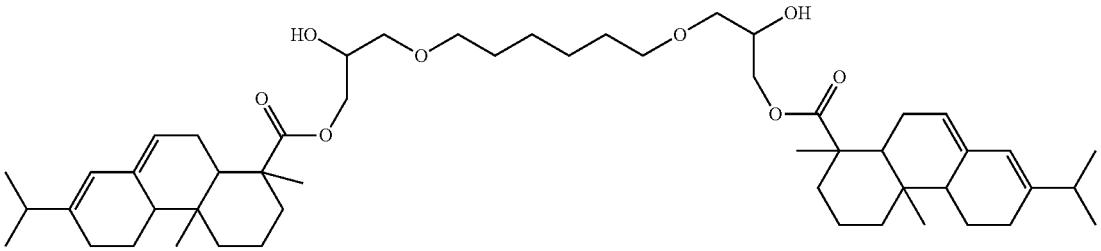
(13)
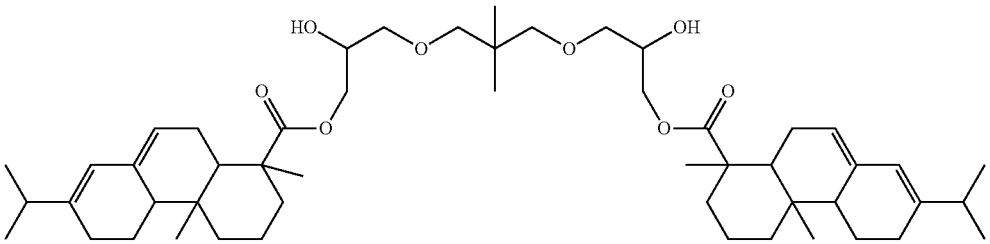

-continued
(14)
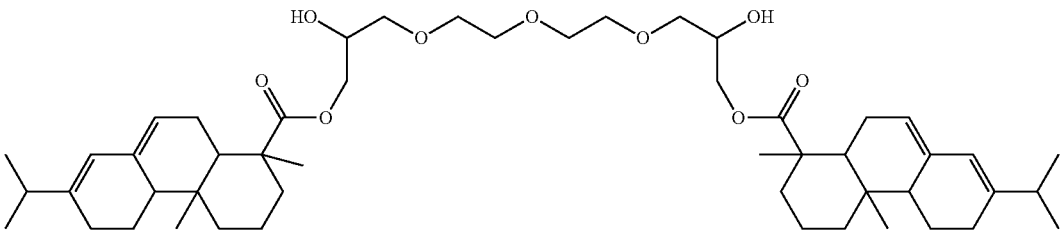
(15)
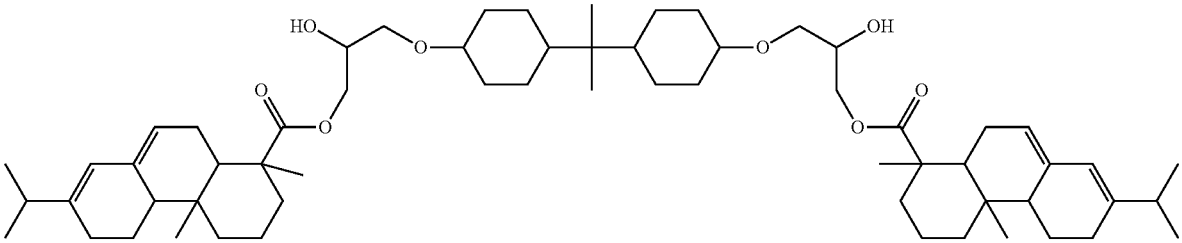
(16)
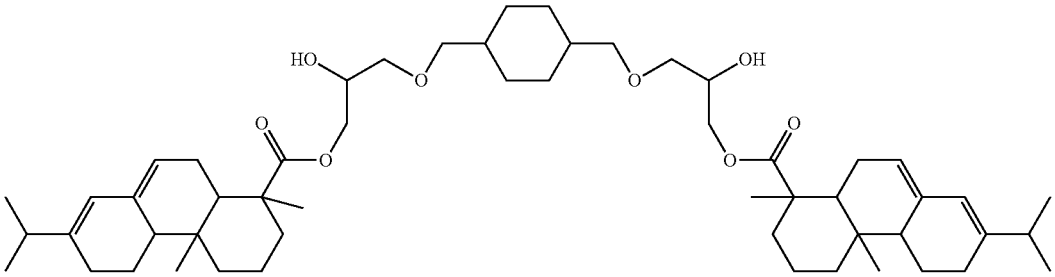
(17)
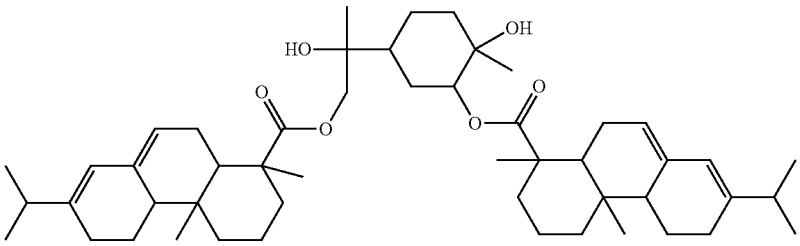
(18)
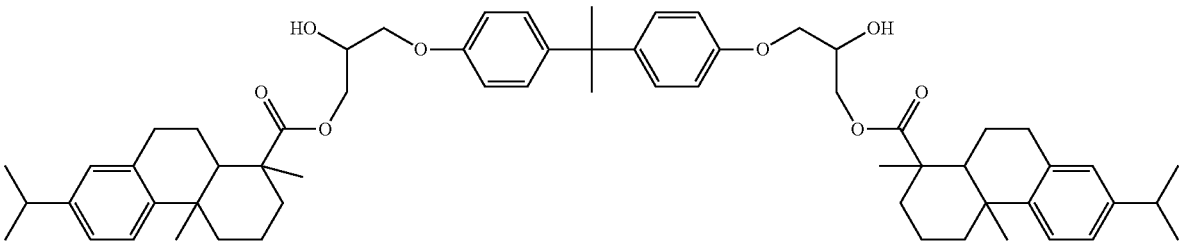
(19)
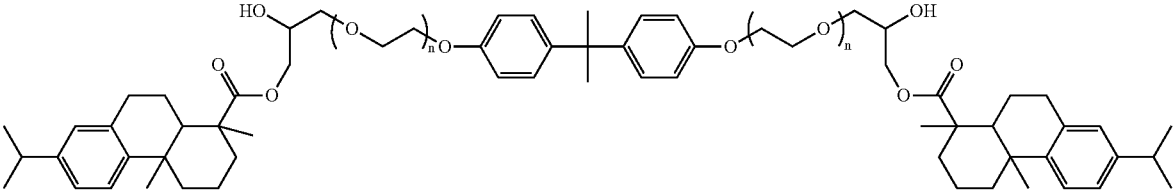

-continued
(20)
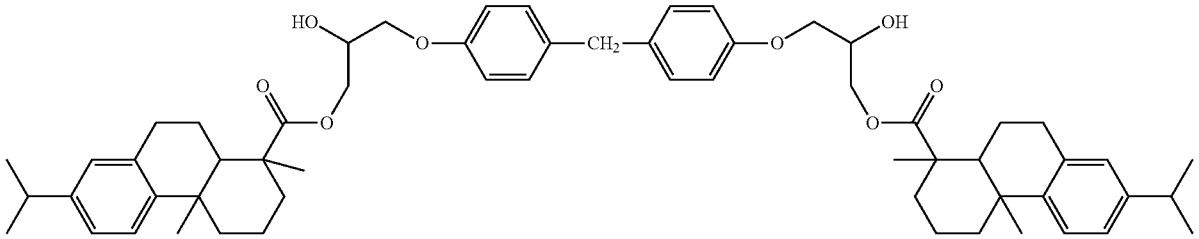
(21)
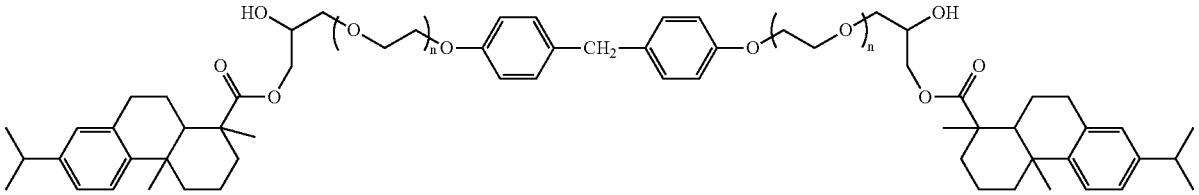
(22)
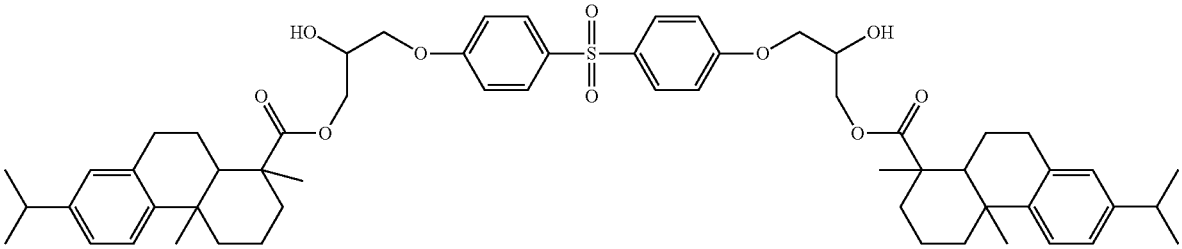
(23)
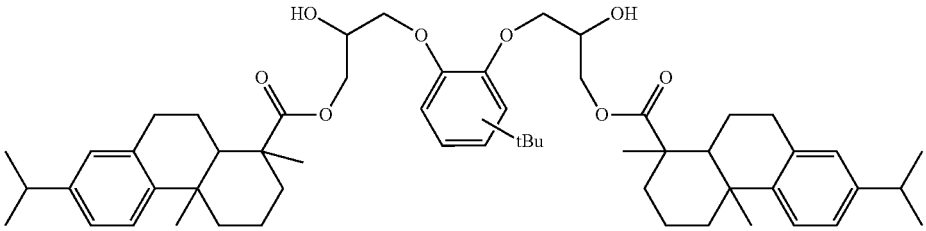
(24)
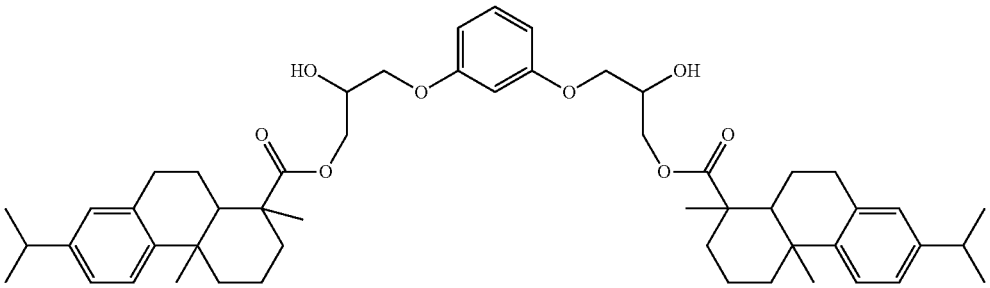
(25)
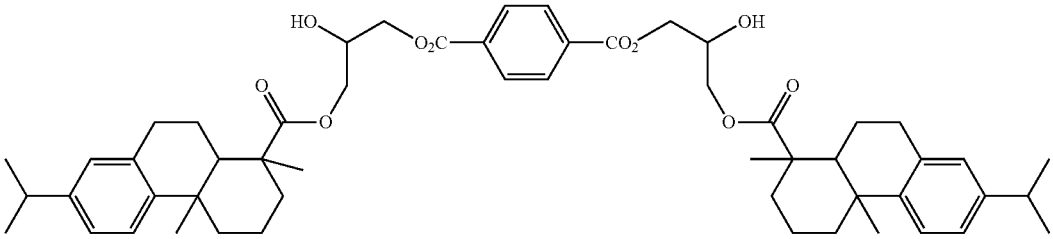

-continued
(26)
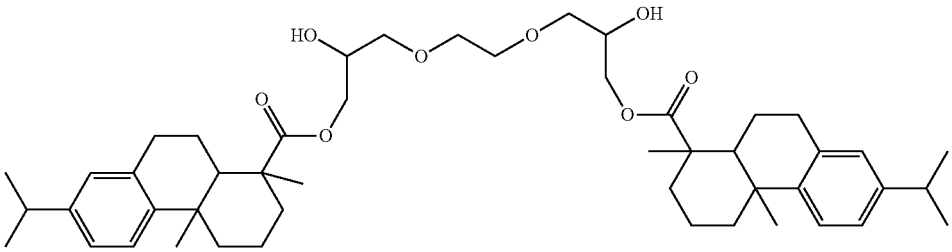
(27)
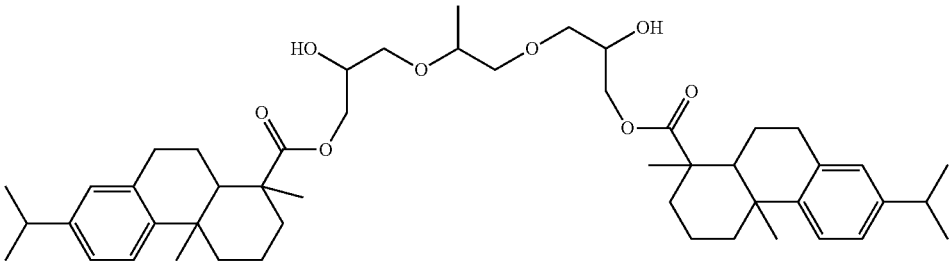
(28)
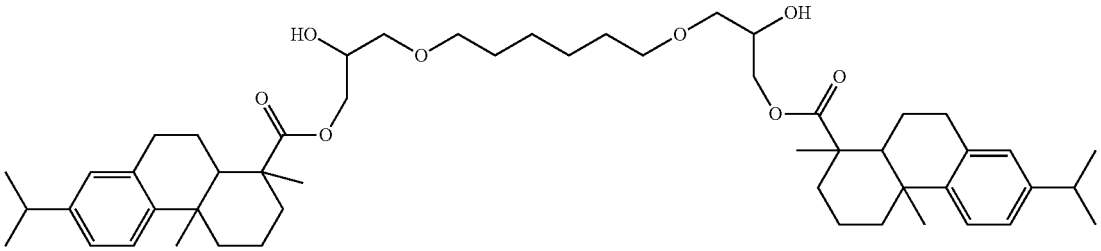
(29)
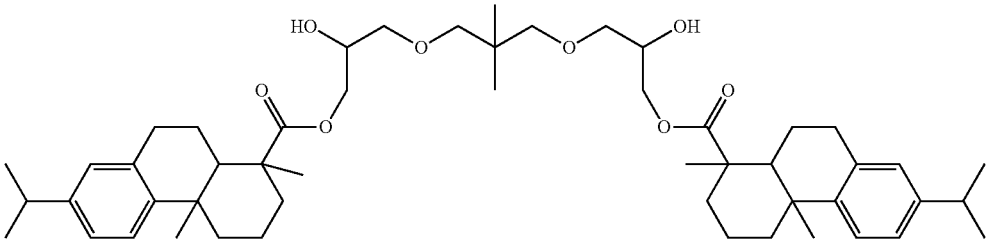
(30)
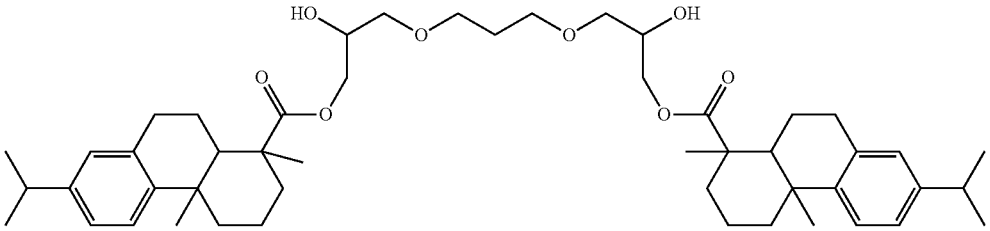
(31)
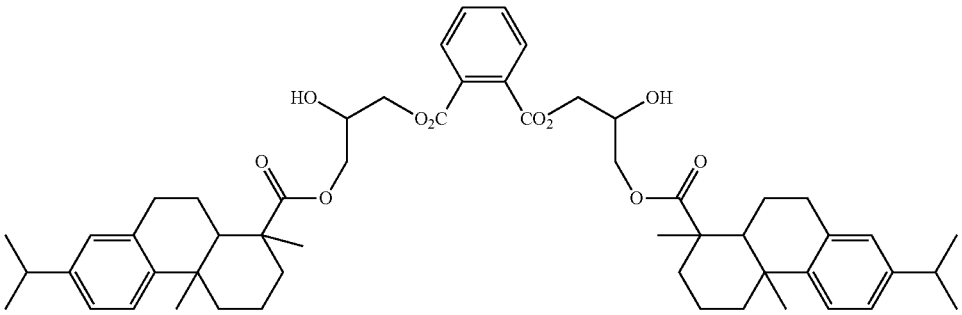

-continued
(32)
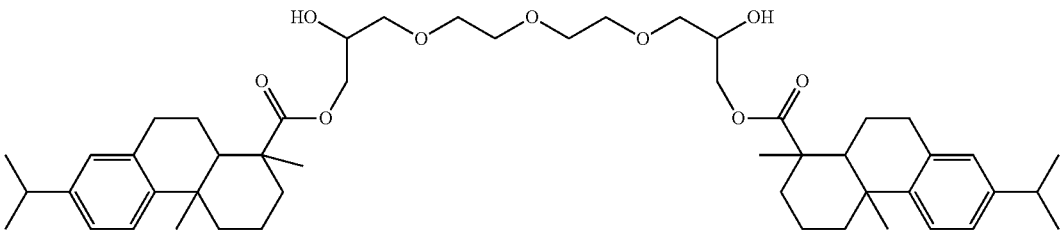
(33)
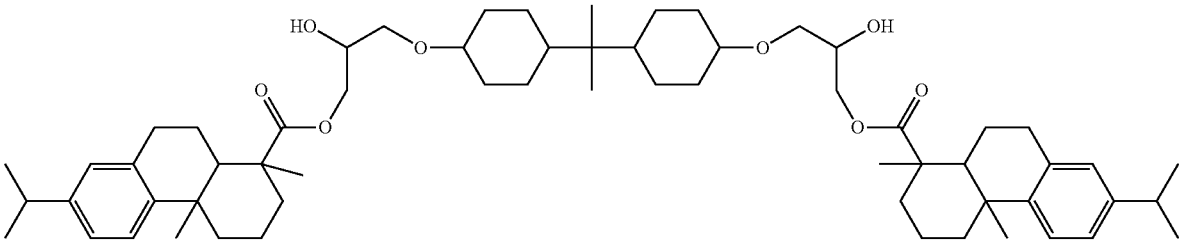
(34)
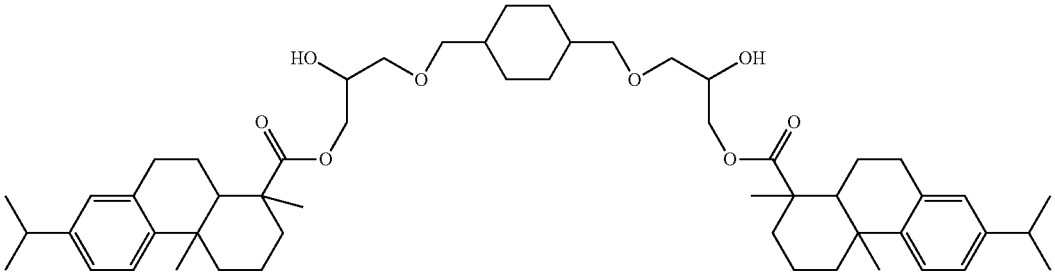
(35)
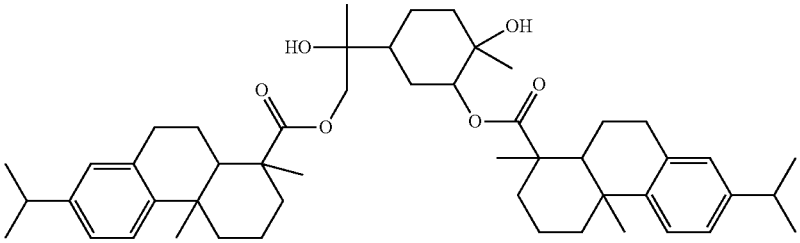
(36)
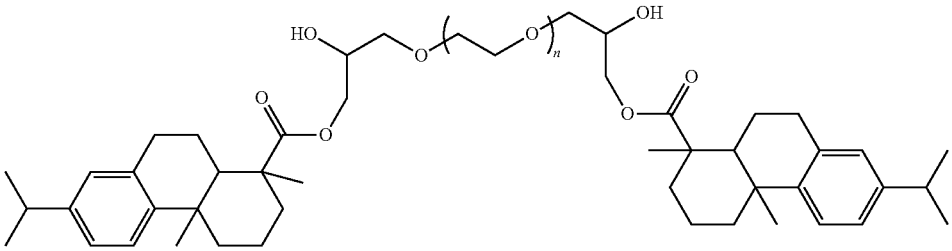
(37)
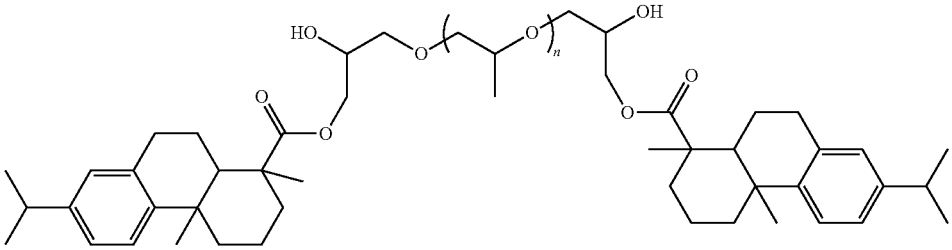

-continued
(38)
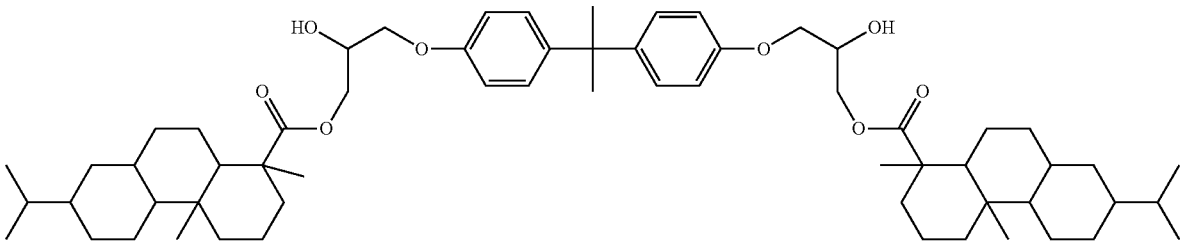
(39)
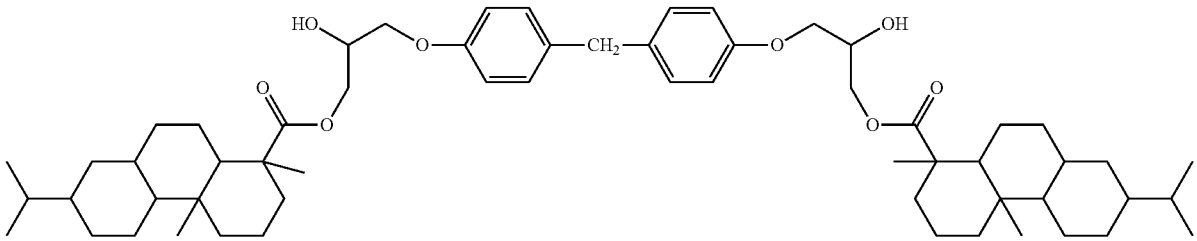
(40)
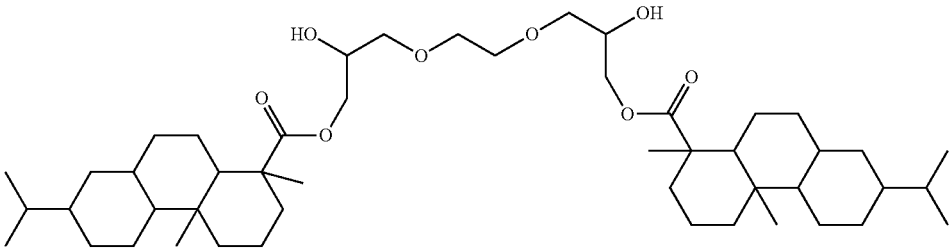
(41)
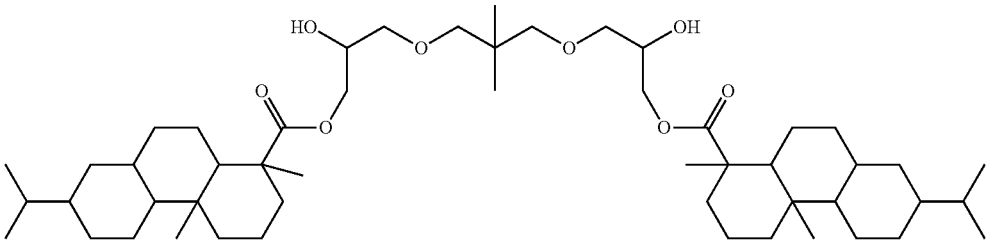
(42)
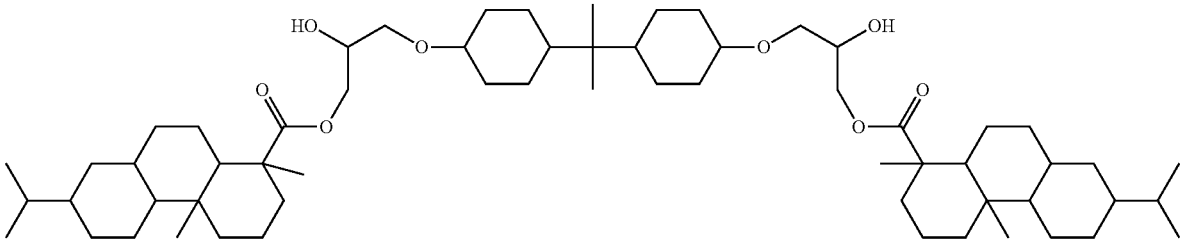

In the exemplary compounds of the specific rosin diol, n represents an integer of 1 or more.

It is preferable that the specific rosin diol be rosin dial represented by Formula (II) below. Therefore, it is preferable that the specific rosin-based polyester resin be a polycondensate of rosin diol represented by Formula (II) and a dicarboxylic acid.

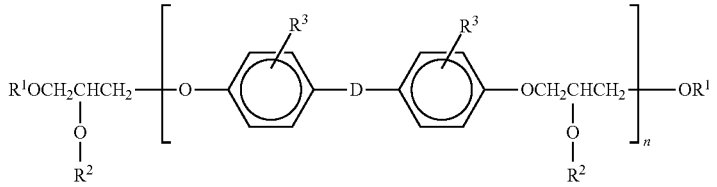

(II)

In Formula (II), $R^1$ represents a stabilized rosin residue or two kinds of groups including a stabilized rosin residue and a monobasic acid group and n represents an integer of from 1 to 6. When n represents 1, $R^2$ represents a hydrogen atom and when n represents 2 or more, two of $R^2$s represent a hydrogen atom and the other $R^2$s represent an acetoacetyl group or two or more kinds of groups including an acetoacetyl group and at least one monobasic acid group. $R^3$ represents at least one kind selected from a hydrogen atom and a halogen atom and D represents a methylene group or an isopropylene group.

In Formula (II), a stabilized rosin residue represented by $R^1$ corresponds to E-CO when stabilized rosin is represented by E-COOH (E represents the molecular skeleton of stabilized rosin from which a carboxy group is excluded), and the stabilized rosin residue is a group containing carbonyl (—CO—) in an ester bond (—CO—O—) of a stabilized-rosin-modified epoxy compound which is obtained by a reaction of an epoxy compound and stabilized rosin.

In this case, examples of a bisphenol-type epoxy compound include well-known epoxy compounds such as a bisphenol A-type epoxy compound, a bisphenol F-type epoxy compound, and a bisphenol A-type brominated epoxy compound.

Examples of stabilized rosin include disproportionated rosin, hydrogenated rosin, and so-called colorless rosin which is obtained by optionally treating natural rosin in a disproportionation process, a hydrogenation process, and a purification process.

In Formula (II), n represents the number of skeleton units of the bisphenol-type epoxy compound which is preferably an integer of from 1 to 6 (1 unit to 6 units) and more preferably an integer of from 2 to 5 (2 units to 5 units). When the number of skeleton units is equal to or less than 6, the increase in the viscosity of rosin diol represented by Formula (II) may be suppressed and the specific rosin-based polyester resin may be easily synthesized. It is the minimum requirement for the bisphenol-type epoxy compound that the number of skeleton units is equal to or greater than 1.

The mixing ratio of the bisphenol-type epoxy compound to stabilized rosin is from 0.3 mole to 1.2 moles and preferably from 0.5 mole to 0.9 mole, with respect to 1 mole equivalent of epoxy group of the epoxy compound. When the ratio of stabilized rosin is equal to or less than 1.2 moles, unreacted rosin may barely remain in the specific rosin-based polyester resin.

At the time of the reaction of the bisphenol-type epoxy compound and stabilized rosin, stabilized rosin may be used in combination with monobasic acid, or they may be sequentially added. In this case, it is preferable that the ratio of the monobasic acid is equal to or less than 0.7 mole with respect to 1 mole equivalent of epoxy group of the epoxy compound.

In Formula (II), the monobasic acid represented by $R^1$ is an acid group having a single hydrogen atom, which may be replaced with another cation, in a single molecule.

As the monobasic acid, for example, at least one kind of saturated or unsaturated aliphatic carboxylic acid having from 1 to 18 carbon atoms and saturated or unsaturated aliphatic carboxylic acid or aromatic carboxylic acid having from 6 to 11 carbon atoms is used. Specific examples thereof include acetic acid, propionic acid, butyric acid, octylic acid, lauric acid, stearic acid, benzoic acid, t-butylbenzoic acid, hexahydrobenzoic acid, phenylacetic acid, oleic acid, and palmitic acid.

The reaction method of the bisphenol-type epoxy compound and stabilized rosin is not particularly limited and may be, for example, a method of mixing the bisphenol-type epoxy compound and stabilized rosin at the same time. Generally, the reaction temperature is from 180° C. to 240° C. and the reaction time is from 8 hours to 18 hours.

In Formula (II), when n represents 1, $R^2$ represents a hydrogen atom and when n represents 2 or more, two of $R^2$s represent a hydrogen atom and the other $R^2$s represent an acetoacetyl group or two or more kinds of groups including an acetoacetyl group and at least one monobasic acid group.

That is, in Formula (II), when there are two, three or more of $R^2$s, $R^2$s represent two hydrogen atoms in total, which means that a compound represented by Formula (II) is a diol compound.

When $R^2$s represent "an acetoacetyl group or an acetoacetyl group and at least one monobasic acid group", the ratio (mole ratio) of the acetoacetyl groups and the monobasic acid groups is from 65:35 to 100:0 and preferably from 70:30 to 100:0 (acetoacetyl group monobasic acid).

"An acetoacetyl group or an acetoacetyl group and at least one monobasic acid group" represented by $R^2$ is obtained by causing a reaction of an epoxy compound (n is equal to 3 or more), which is modified by stabilized rosin and has three or more hydroxyl groups, with a diketene or with a diketene and at least one monobasic acid group.

A diketene is used for introducing an acetoacetyl group into $R^2$ by a reaction with a hydroxyl group of the modified epoxy compound.

When only a diketene is used at the time of introducing an acetoacetyl group into molecules, the amount used thereof is normally from 0.8 mole equivalent to 1.2 mole equivalents, preferably from 1.0 mole equivalent to 1.1 mole equivalents, with respect to 1 mole equivalent of a hydroxyl group of the modified epoxy compound.

In addition, when a diketene and at least one monobasic acid group are used, for controllability of the reaction, a method is preferable in which the monobasic acid group is added to the modified epoxy compound having three or more hydroxyl groups first and diketene is added.

Specifically, in general, 0.35 mole equivalent or less and preferably 0.30 mole equivalent or less of moonobasic acid group may be used for reaction with respect to 1 mole equivalent of hydroxyl groups of the modified epoxy compound, and 0.8 mole equivalent to 1.2 mole equivalents and preferably 1.0 mole equivalent to 1.1 mole equivalents of diketene may be used for reaction with respect to 1 mole equivalent (theoretical value) of residual hydroxyl groups.

During the above reaction, conditions of an esterification of the modified epoxy compound having three or more hydroxyl groups with the monobasic acid group may be the same as those of an esterification of the epoxy compound with stabilized rosin. Following the esterification with stabilized rosin, the esterification with the monobasic acid group may be carried out. In addition, the reaction temperature of the diketene is preferably from 40° C. to 80° C. and the reaction time thereof is preferably from 1 hour to 3 hours.

Since all the esterifications are carried out at high temperature, it is preferable that the esterifications be carried out in an atmosphere of inert gas such as nitrogen gas. In addition, for example, use of a coloring inhibitor, an antioxidant, or the like and use of a catalyst in the respective reaction processes are optional. In addition, the reaction may be carried out in an inert solve t su h as toluene or xylene.

In Formula (II), $R^3$ represents at least one kind selected from a hydrogen atom and a halogen atom and D represents a methylene group or an isopropylene group.

Two $R^1$s in Formula (II) may be the same as or different from each other. In addition, two or more of Ds and $R^3$s may be the same as or different from each other, respectively. In addition, when $R^2$s in Formula (II) represent two or more acetoacetyl groups or two or more kinds of groups including an acetoacetyl group and at least one monobasic acid group, that is when n represents 3 or more, $R^2$s other than two of $R^2$s which represent a hydrogen atom may be the same as or different from each other.

Next, as a dicarboxylic acid component constituting a repeating unit derived from a dicarboxylic acid component of the specific rosin-based polyester resin, at least one kind selected from a group consisting of aromatic dicarboxylic acids and aliphatic dicarboxylic acids may be used.

Examples thereof include aromatic dicarboxylic acids such as phthalic acid, isophthalic acid, terephthalic acid, 1,4-naphthalenedicarboxylic acid, or 2,6-naphthalenedicarboxylic acid; aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, dimer acid, alkylsuccinic acid having a branched chain and from 1 to 20 carbon atoms, and alkenylsuccinic acid having a branched chain and an alkenyl group having 1 to 20 carbon atoms; and anhydrides and alkyl (1 to 3 carbon atoms) esters of the above acids. Among these, an aromatic carboxylic acid compound is preferable from the viewpoints of the durability and fixing property of toner and the dispersibility of a colorant.

In the exemplary embodiment, as a dial component, the specific rosin diol may be used in combination with other dial components. In the exemplary embodiment, the content of the specific rosin dial in the diol component is preferably from 10% by mole to 100% by mole and more preferably from 20% by mole to 90% by mole, from the viewpoint of mechanical strength.

As other alcohols components other than the specific rosin dial, at least one kind selected from a group consisting of aliphatic dial and etherified diphenol may be used in a range that does not impair toner performance.

Examples of the aliphatic diol, include ethylene glycol, 1,2-propanediol 1,3-propanediol 1,2-butanediol, 1,3-butanediol, 1,4-butanediol 2,3-butanediol 1,4-butenediol, 2-methyl-1,3-propanediol, 1,5-pentanediol neopentyl glycol, ethyl-2-methylpropane-1,3-diol, 2-butyl-2-ethylpropane-1,3-diol, 1,6-hexanediol, 3-methyl-1,5-pentanediol, 2-ethyl-1,3-hexanediol, 2,4-dimethyl-1,5-pentanediol, 2,2,4-trimethyl-1,3-pentanediol, 1,7-heptanediol, 1,8-octanediol, 1,9-nonanediol 1,10-decanediol, 3-hydroxy 2,2-dimethylpropyl-3-hydroxy-2,2-dimethyl propanoate, diethylene glycol, triethylene glycol, polyethylene glycol, dipropylene glycol, and polypropylene glycol. The aliphatic diol may be used alone or in a combination of two or more kinds.

In addition, in the exemplary embodiment, the etherified diphenol may be further used in combination with the aliphatic diol. The etherified diphenol is a diol obtained through an additional reaction of bisphenol A and alkylene oxide, in which ethylene oxide or propylene oxide is used as an alkylene oxide. In this case, it is preferable that the average additional molar number of the alkylene oxide be from 2 moles to 16 moles with respect to 1 mole of bisphenol A.

The specific rosin-based polyester resin may be prepared using the dicarboxylic acid component and the diol component as a base material in a well-known preparation method, for example, the ester exchange method which is described above as the synthesis method of the aliphatic polyester resin or a direct esterification method. At the time of the synthesis, the above-described polycondensation catalyst may be used as a catalyst. The addition amount of the catalyst is preferably from 0.01 part to 1.5 parts and more preferably from 0.05 part to 1.0 part with respect to 100 parts (total amount) of the dicarboxylic acid component and the diol component. The reaction temperature is preferably from 180° C. to 300° C.

From the viewpoints of the fixing property, the preservability, and the durability of the toner, the softening temperature of the specific rosin-based polyester resin is preferably from 80° C. to 160° C. and more preferably from 90° C. to 150° C. in addition, the glass transition temperature of the specific rosin-based polyester resin is preferably from 35° C. to 80° C. and more preferably from 40° C. to 70° C. from the viewpoints of the fixing property, the preservability, and the durability of the toner. The softening temperature and the glass transition temperature are easily adjusted by changing the compositions of base monomers, a polymerization initiator, the molecular weight, or the amount of a catalyst; or selecting the reaction conditions.

The specific rosin-based polyester resin may be modified polyester. Examples of the modified polyester include polyesters which are grafted or blocked by phenol, urethane, epoxy or the like in methods disclosed in JP-A-11-133668, JP-A-10-239903, and JP-A-8-20636.

In the toner according to the exemplary embodiment, it is preferable that the aliphatic polyester resin and the specific rosin-based polyester resin be used in the following ratio.

That is, it is preferable that a content ratio of the aliphatic polyester resin to the specific rosin-based polyester resin be from 5/95 to 40/6 (aliphatic polyester resin/specific rosin-based polyester resin) in terms of weight. When the content ratio of the aliphatic polyester resin to the specific rosin-based polyester resin is equal to or greater than 5/95, the biodegradability of the toner increases and when the content ratio is equal to or less than 40/60, the strength of the toner may be easily maintained.

The content ratio of the aliphatic polyester resin to the specific rosin-based polyester resin is more preferably from 6/94 to 30/70 and still more preferably from 8/92 to 20/80.

By using the aliphatic polyester resin and the specific rosin-based polyester resin as a binder resin of the toner, the strength may be maintained and a toner having satisfactory biodegradability may be obtained.

In the toner according to the exemplary embodiment, the above binder resin may be used in combination with another binder resin, for example, a well-known binder resin such as a vinyl resin such as styrene-acrylic resin, epoxy resin, polycarbonate resin, or polyurethane resin. In this case, it is preferable that the content of the specific rosin-based polyester resin according to the exemplary embodiment in the binder resin be equal to or greater than 70%, more preferably equal to or greater than 90%, and still more preferably equal to 100% in a practical way.

The toner according to the exemplary embodiment contains the aliphatic polyester resin and the specific rosin-based polyester resin, and optionally may further contain other components such as a colorant, a release agent, and an external additive.

Colorant

A colorant used in the exemplary embodiment may be a dye or a pigment, but a pigment is preferable from the viewpoints of lightfastness and water resistance.

Preferable examples of the colorant include well-known pigments such as Carbon Black, Aniline Black, Aniline Blue, Calco Oil Blue, Chrome Yellow, Ultramarine Blue, Du Pont Oil Red, Quinoline Yellow, Methylene Blue Chloride, Phthalocyanine Blue, Malachite Green Oxalate, Lamp Black, Rose Bengal, Quinacridone, Benzidine Yellow, C.I. Pigment Red 48:1, C.I. Pigment Red 57:1, C.I. Pigment Red 122, C.I. Pigment Red 185, C.I. Pigment Red 238, C.I. Pigment Yellow 12, C.I. Pigment Yellow 17, C.I. Pigment Yellow 180, C.I. Pigment Yellow 97, C.I. Pigment Yellow 74 C.I. Pigment Blue 15:1, and C.I. Pigment Blue 15:3.

It is preferable that the content of the colorant in the toner be from 1 part by weight to 30 parts by weight with respect to 100 parts by weight of the binder resin. In addition, optionally, a surface-treated colorant or a pigment dispersant may be used. By selecting the kind of the colorant, yellow toner, magenta toner, cyan toner, or black toner my be obtained.

Examples of the release agent include paraffin wax such as low molecular weight polypropylene or low molecular weight polyethylene; silicone resin; rosins; rice wax; and carnauba wax. The melting temperature of the release agent is preferably from 50° C. to 100° C. and more preferably from 60° C. to 95° C. The content of the release agent in the toner is preferably from 0.5% by weight to 15% by weight and more preferably from 1.0% by weight to 12% by weight. When the content of the release agent is equal to or greater than 0.5% by weight, separation failure is prevented in the case of oil-less fixing. When the content of the release agent is equal to or less than 15% by weight, the fluidity of toner does not deteriorate and the quality and reliability of a formed image are improved.

As a charge control agent, for example, well-known charge control agents are used, and a resin type charge control agent containing an azo-based metal complex compound, a metal complex compound of salicylic acid, and a polar group may be used.

As the external additives, the toner particles may contain white inorganic powder in order to improve fluidity. Examples of appropriate inorganic powder include powders of silica, alumina, titanium oxide, barium titanate, magnesium titanate, calcium titanate, strontium titanate, zinc oxide, silica sand, clay, mica, wollastonite, diatom earth, chromium oxide, cerium oxide, red iron oxide, antimony trioxide, magnesium oxide, zirconium oxide, barium sulfate, barium carbonate, calcium carbonate, silicon carbide, silicon nitride, but silica powder is particularly preferable. In general, the content of the inorganic powder in the toner is from 0.01 part to 5 parts and preferably from 0.01 part to 2.0 parts, with respect to 100 parts of the toner. In addition, the inorganic powder may be used in combination with well-known materials such as silica, titanium, resin particles (particles of polystyrene resin, PMMA resin, melamine resin, or the like) and alumina. In addition, as a cleaning activator, a metal salt of a higher fatty acid which is represented by zinc stearate or particles of a fluorine polymer may be added.

Toner Properties

The shape factor SF1 of the toner according to the exemplary embodiment is preferably from 110 to 150 and more preferably from 120 to 140.

The above-described shape factor SF1 is obtained by Expression (S) below.

$$SF1=(ML^2/A)\times(\pi/4)\times 100 \qquad \text{Expression (S)}$$

In Expression (S), ML represents the absolute maximum length of the toner and A represents the projection area of the toner.

Numerical values of SF1 are obtained by analyzing a microscopic image or a scanning electron microscopic (SEM) image using an image analyzer. For example, the values may be calculated as follows. That is, an optical microscopic image of particles which are dispersed on a slide glass surface is input to a Luzex image analyzer through a video camera, maximum lengths and projection areas of 100 particles are obtained and calculated using Expression (5) above, and the average values thereof are obtained. As a result, the numerical values of the SF1 are obtained.

The volume average particle size of the toner according to the exemplary embodiment is preferably from 8 μm to 15 μm, more preferably from 9 μm to 14 μm, and still more preferably from 10 μm to 12 μm.

The volume average particle size is measured using a Coulter Multisizer (manufactured by Beckman Coulter, Inc.) with an aperture diameter of 50 μm. At this time, toner is measured after being dispersed into an electrolyte aqueous solution (aqueous isotonic solution) using ultrasonic waves for 30 seconds or more.

The preparation method of the toner according to the exemplary embodiment is not particularly limited, but toner particles may be prepared by well-known methods such as a dry method (for example, a kneading and pulverizing method) and a wet method (for example, an emulsion aggregation method and a suspension polymerization method) and optionally, an external additive is added to the toner particles, thereby obtaining a toner.

In the above-described kneading and pulverizing method, first, components of the binder resin, the colorant, the release agent, and the like are mixed, melted, and kneaded. Examples of a melt-kneading machine include a three-roll type, a single screw type, a twin screw type, and a Banbury mixer type. The obtained kneaded material is coarsely pulverized and finely pulverized using a pulverizer such as a micronizer, an Ulmax, a jet-O-mizer, a jet mill, a Kryptron, or a turbo mill, followed by classification with a classifier such as an Elbow-jet, Microplex, or DS separator. As a result, a toner is obtained.

In the toner according to the exemplary embodiment, in order to maintain the strength of the toner and suppress deterioration in the biodegradability of the aliphatic polyester resin, at the same time, it is preferable that the aliphatic polyester resin and the specific rosin-based polyester resin be mixed without being deviated in the toner. In order for the toner to have the above-described configuration, it is preferable that the toner be prepared in a wet method such as an emulsion aggregation method and a suspension polymerization method.

The emulsion aggregation method may include an emulsion process of emulsifying base materials of toner and forming resin particles (emulsified particles); an aggregation process of forming aggregates containing the resin particles; and a coalescence process of coalescing the aggregates.

Emulsion Process

For example, a resin particle dispersion may be prepared by a disperser applying a shearing force to a solution in which an aqueous medium and a binder resin are mixed. At this time, particles may be formed by heating a resin component to lower the viscosity thereof. In addition, in order to stabilize the dispersed resin particles, a dispersant may be used.

Furthermore, when resin is dissolved in an oil-based solvent having relatively low solubility in water, the resin is dissolved in the solvent and particles thereof are dispersed in water with a dispersant and a polymer electrolyte, followed by heating and reduction in pressure to evaporate the solvent. As a result, the resin particle dispersion is prepared.

In this case, when the resin particle dispersion is prepared, it is preferable that the aliphatic polyester resin and the specific rosin-based polyester resin, which are at least used as the binder resin, be mixed at the above-described mixing ratio. However, the mixing conditions such as mixing order are not particularly limited.

Examples of the aqueous medium include water such as distilled water or ion exchange water; and alcohols, and water only is preferable.

In addition, examples of the dispersant which is used in an emulsification process include a water-soluble polymer such as polyvinyl alcohol, methyl cellulose, ethyl cellulose, hydroxyethyl cellulose, carboxymethyl cellulose, sodium polyacrylate, or poly(sodium methacrylate); a surfactant such as an anionic surfactant (for example, sodium dodecylbenzenesulfonate, sodium octadecylsulfate, sodium oleate, sodium laurate, or potassium stearate), a cationic surfactant (for example, laurylamine acetate, stearylamine acetate, or lauryltrimethylammonium chloride), a zwitterionic surfactant (for example, lauryl dimethylamine oxide), or a nonionic surfactant (for example, polyoxyethylene alkyl ether, polyoxyethylene alkyl phenyl ether, or polyoxyethylene alkylamine); and an inorganic salt such as tricalcium phosphate, aluminum hydroxide, calcium sulfate, calcium carbonate, or barium carbonate.

Examples of the disperser which is used for preparing an emulsion include a homogenizer, a homomixer, a pressure kneader, an extruder, and a media disperser. With regard to the size of the resin particles, the average particle size (volume average particle size) thereof is preferably lower than or equal to 1.0 μm, more preferably from 60 nm to 300 nm, and still more preferably from 150 nm to 250 nm. When the volume average particle size is lower than 60 nm, the resin particles are stabilized in the dispersion and thus the aggregation of the resin particles may be difficult. In addition, when the volume average particle size is greater than 1.0 μm, the aggregability of the resin particles is improved and the toner particles are easily prepared. However, the distribution of toner particle sizes may be spread out.

When a release agent particle dispersion is prepared, a release agent is dispersed in water with an ionic surfactant and a polyelectrolyte such as a polyacid or a polymeric base and the resultant is heated at a temperature equal to or higher than the softening temperature of the release agent, followed by dispersion using a homogenizer to which strong shearing force is applied and a pressure extrusion type disperser. Through the above-described process, a release agent particle dispersion is obtained. During the dispersion, an inorganic compound such as polyaluminum chloride may be added to the dispersion. Preferable examples of the inorganic compound include polyaluminum chloride, aluminum sulfate, basic aluminum chloride (BAC), polyaluminum hydroxide and aluminum chloride. Among these, polyaluminum chloride and aluminum sulfate are preferable. The release agent particle dispersion is used in the emulsion aggregation method, but may also be used when the toner is prepared in the suspension polymerization method.

Through the dispersion, the release agent particle dispersion having release agent particles with a volume average particle size of 1 μm or less is obtained. It is more preferable that the volume average particle size of the release agent particles be from 100 nm to 500 nm.

When the volume average particle size is less than 100 nm, in general, although also being affected by properties of a binder resin to be used, it is difficult to mix a release agent component into toner. In addition, when the volume average particle size is greater than 500 nm, the dispersal state of the release agent in the toner may be insufficient.

When a colorant particle dispersion is prepared, a well-known dispersion method may be used. For example, general dispersion units such as a rotary-shearing homogenizer, a ball mill having a medium, a sand mill, a dyno mill, or an ultimzer are used, but the dispersion method is not limited thereto. A colorant is dispersed in water with an ionic surfactant and a polyelectrolyte such as a polyacid or a polymeric base. The volume average particle size of the dispersed colorant particles may be equal to or less than 1 μm, but preferably from 80 nm to 500 nm because the colorant is uniformly dispersed in the toner without impairing aggregability.

Aggregation Process

In the aggregation process, the resin particle dispersion, the colorant particle dispersion, the release agent particle dispersion and the like are mixed to obtain a mixture and the mixture is heated at the glass transition temperature or lower of the resin particles and aggregated to form aggregated particles. The aggregated particles are formed by adjusting the pH value of the mixture to be acidic while stirring the mixture. The pH value is preferably from 2 to 7. At this time, use of a coagulant is also effective.

In the aggregation process, the release agent particle dispersion and other various dispersions such as the resin particle dispersion may be added and mixed at once or across multiple times.

As the coagulant, a surfactant having a reverse polarity to that of a surfactant which is used as the dispersant; an inorganic metal salt; and a divalent or higher metal complex may be preferably used. In particular, the metal complex is particularly preferable because the amount of the surfactant used may be reduced and a charge performance is improved.

Preferable examples of the inorganic metal salt include an aluminum salt and a polymer thereof. In order to obtain a sharper particle size distribution, a divalent inorganic metal salt is preferable to a monovalent inorganic metal salt, a trivalent inorganic metal salt is preferable to a divalent inorganic metal salt, and a tetravalent inorganic metal salt is preferable to a trivalent inorganic metal salt. In addition, when inorganic metal salts having the same valence are compared, a polymer type of inorganic metal salt polymer is more preferable.

In addition, after the aggregated particles have desired particle sizes, the resin particle dispersion is added (coating process). As a result, a toner having a configuration in which the surfaces of core aggregated particles are coated with resin may be prepared. In this case, the release agent and the colorant are not easily exposed to the surface of the toner, which is preferable from the viewpoints of a charging property and developability. When additional components are added, a coagulant may be added to adjust the pH value, before and after the addition.

Coalescing Process

In the coalescing process, under stirring conditions based on the aggregation process, by increasing the pH value of a suspension of the aggregated particles to be in a range of 3 to 9, aggregation is stopped. Then, heating is performed at the glass transition temperature or higher of the resin to coalesce the aggregated particles. In addition, when the resin is used for coating, the resin is also coalesced and coats the core aggregated particles. The heating time may be determined according to a coalescing degree and may be approximately from 0.5 hours to 10 hours.

After coalescing, cooling is performed to obtain coalesced particles. In addition, in a cooling process, a cooling rate may be reduced around the glass transition temperature of the resin (the range of the glass transition temperature±10° C.), that is, so-called slow cooling may be performed to promote crystallization.

The coalesced particles which are obtained after coalescing may be subjected to a solid-liquid separation process such as filtration, and optionally to a cleaning process and a drying process to obtain toner particles. When an external additive is not added to the toner particles, the obtained toner particles may be used as a toner.

External Additive Addition Process

Optionally, an external additive such as a fluidizing agent or an aid may be added to the obtained toner particles. As the external additive, the above-described well-known particles are used.

Electrostatic Charge Image Developer

A developer according to the exemplary embodiment contains at least the toner according to the exemplary embodiment.

The toner according to the exemplary embodiment may be used as a single-component developer or a two-component developer. When used as a two-component developer, the toner according to the exemplary embodiment is mixed with a carrier.

The carrier which may be used for the two-component developer is not particularly limited, and a well-known carrier may be used. For example, a resin-coated carrier which has a resin coating layer on the surface of a core material formed of a magnetic metal such as iron oxide, nickel, or cobalt and a magnetic oxide such as ferrite magnetite; and a magnetic powder-dispersed carrier may be used. In addition, a resin-dispersed carrier in which a conductive material and the like are dispersed in a matrix resin may be used.

In the two-component developer, the mixing ratio (weight ratio) of the toner and the carrier according to the exemplary embodiment is preferably from 1:100 to 30:100 (tones:carrier) and more preferably from 3:100 to 20:100.

Image Forming Apparatus and Image Forming Method

Next, an image forming apparatus according to the exemplary embodiment using the developer according to the exemplary embodiment will be described.

The image forming apparatus according to the exemplary embodiment includes a latent image holding member; a charging unit that charges a surface of the latent image holding member; an electrostatic latent image forming unit that forms an electrostatic latent image on the surface of the latent image holding member; a developing unit that contains the developer according to the exemplary embodiment and forms a toner image by developing the electrostatic latent image using the developer according to the exemplary embodiment; a transfer unit that transfers the toner image onto a recording medium; and a fixing unit that fixes the toner image on the recording medium.

An image forming method according to the exemplary embodiment is performed by the image forming apparatus according to the exemplary embodiment, and includes a charging process of charging a surface of a latent image holding member; a latent image forming process of forming an electrostatic latent image on the surface of the latent image holding member a developing process of forming a toner image by developing the electrostatic latent image using the developer according to the exemplary embodiment; a transfer process of transferring the toner mage onto a recording medium; and a fixing process of fixing the toner image on the recording medium.

In addition, in the image forming apparatus, for example, a portion including the developing unit may have a cartridge structure (process cartridge) which is detachable from the image forming apparatus main body. As the process cartridge, a process cartridge according to the exemplary embodiment is preferably used that includes the developing unit that contains the developer according to the exemplary embodiment and forms a toner image by developing the electrostatic latent image, which is formed on the surface of the image holding member, using the developer; and is detachable from an image forming apparatus.

Hereinafter, an example of the image forming apparatus according to the exemplary embodiment will be described, but does not limit the exemplary embodiment. In addition main components shown in the drawing will be described, and the descriptions of the other components will be omitted.

FIG. 1 is a diagram schematically illustrating the configuration of a four-tandem color image forming apparatus. The image forming apparatus shown in FIG. 1 includes first to fourth electrophotographic image forming units 10Y 10M, 10C, and 10K which output images of the respective colors including yellow (Y) magenta (M), cyan (C), and black (K) on the basis of separate color image data. Such image forming units (hereinafter, sometimes referred to as "the units") 10Y, 10M 10C, and 10K are horizontally provided in line at predetermined intervals. The units 10Y, 10M, 10C, and 10K may be process cartridges which are detachable from the image forming apparatus main body.

On the upper side (in the drawing) of the respective units 10Y, 10M, 10C, and 10K, an intermediate transfer belt 20 as an intermediate transfer a ember extends through the respective units. The intermediate transfer belt 20 is wound around a driving roller 22 and a supporting roller 24 in contact with the inner surface of the intermediate transfer belt 20 and travels in a direction from the first unit 10Y toward the fourth unit 10K, in which the rollers are disposed to be distant from each other in the direction from the left to the right in the drawing. In this case, the supporting roller 24 is biased in a direction away from the driving roller 22 by a spring (not shown) and a predetermined tension strength is applied to the intermediate transfer belt 20 wound around both of the rollers. In addition, on the latent image holding member side of the intermediate transfer belt 20, an intermediate transfer ember cleaning device 30 is provided opposite the driving roller 22.

In addition, toners of four colors including yellow, magenta, cyan, and black, which are included in toner cartridges 8Y, 8M, 8C, and 8K, may be respectively supplied to developing devices (developing units) 4Y, 4M, 4*c*, and 4K of the respective units 10Y, 10M, 10C, and 10K.

Since the first to fourth units 10Y, 10M, 10C, and 10K have the same configuration, the first unit 10Y, which is disposed on the upstream side in the travelling direction of the intermediate transfer belt and forms a yellow image, will be described as a representative example. In addition, the same components as those of the first unit 10Y are represented by reference numerals to which the symbols M (magenta), C (cyan) and K (black) are attached instead of the symbol Y (yellow), and the descriptions of the second to fourth units 10M, 10C, and 10K, will not be repeated.

The first unit 10Y includes a photoreceptor 1Y which functions as the latent image holding member. In the vicinity of the photoreceptor 1Y, a charging roller 2Y that charges the surface of the photoreceptor 1Y to a predetermined potential; an exposure device 3 that exposes the charged surface to a laser beam 3Y on the basis of separate color image signals to form an electrostatic latent image; the developing device (developing unit) 4Y that supplies charged toner to the electrostatic latent image to develop the electrostatic latent image; a primary transfer roller 5Y (primary transfer unit) that transfers the developed toner image onto the intermediate transfer belt 20; and a photoreceptor cleaning device (cleaning unit) 6Y that removes toner remaining on the surface of the photoreceptor 1Y after the primary transfer are disposed in this order.

In this case, the primary transfer roller 5Y is disposed inside the intermediate transfer belt 20 and opposite the photoreceptor 1Y. Furthermore, bias power supplies (not shown), which apply primary transfer biases, are respectively connected to the primary transfer rollers 5Y, 5M, 5C and 5K. A controller (not shown) controls the respective bias power supplies to change the primary transfer biases which are applied to the respective primary transfer rollers.

Hereinafter, the operation of forming a yellow image in the first unit 10Y will be described. First, prior to the operation, the surface of the photoreceptor 1Y is charged to a potential of about −600 V to about −800 V by the charging roller 2Y.

The photoreceptor 1Y is formed by laminating a photosensitive layer on a conductive substrate (volume resistivity at 20° C.: $1\times10^{-6}$ Ω·cm or low. In general, this photosensitive layer has high resistance (resistance similar to that of general resin), and has a property in which, when irradiated with the laser beam 3Y, the specific resistance of a portion irradiated with the laser light changes. Therefore, the charged surface of the photoreceptor 1Y is irradiated with the laser beam 3Y through the exposure device 3 in accordance with yellow image data which is output from the controller (not shown). The laser beam 3Y is emitted to the photosensitive layer on the surface of the photoreceptor 1Y. As a result, an electrostatic latent image having a yellow printing pattern is formed on the surface of the photoreceptor 1Y.

The electrostatic latent image is an image which is formed on the surface of the photoreceptor 1Y through charging and a so-called negative latent image which is formed through the following processes: the specific resistance of a portion, which is irradiated with the laser beam 3Y, of the photosensitive layer is reduced and electric charge flows on the surface of the photoreceptor 1Y whereas electric charge remains on a portion which is not irradiated with the laser beam 3Y.

The electrostatic latent image which is formed on the photoreceptor 1Y in this way is rotated to a predetermined development position along with the movement of the photoreceptor 1Y. At this development position, the electrostatic latent image on the photoreceptor 1Y is visualized (developed) by the developing device 4Y.

Yellow developer included in the developing device 4Y is triboelectrically charged by being agitated in the developing device 4Y, contains electric charge having the same polarity (negative polarity) as that of the electric charge on the photoreceptor 1Y, and is held on a developer roller (developer holding ember). As the surface of the photoreceptor 1Y passes through the developing device 4Y, yellow toner is electrostatically attached to a latent image portion, which is erased, on the photoreceptor 1Y. Accordingly, a latent image is developed by the yellow toner. The photoreceptor 1Y on which the yellow toner image is formed travels at a predetermined rate and the toner image which is developed on the photoreceptor 1Y is transported to a predetermined primary transfer position.

When the yellow toner image on the photoreceptor 1Y is transported to the primary transfer position, a predetermined primary transfer bias is applied to the primary roller 5Y, electrostatic force is applied to the toner image in a direction from the photoreceptor 1Y to the primary transfer roller 5Y, and the toner image on the photoreceptor 1Y is transferred onto the intermediate transfer belt 20. The transfer bias applied at this time has positive polarity opposite to negative polarity of the toner and, for example, in the first unit 10Y, is controlled to about 10 μA by the controller (not shown).

Meanwhile, toner remaining on the photoreceptor 1Y is removed and recovered by the cleaning device 6Y.

In addition, primary transfer biases, which are applied to the primary transfer rollers 5M, 5C, and 5K of the second to fourth units 10M to 10K, are also controlled according to the first unit.

In this way, the intermediate transfer belt 20, onto which the yellow toner image is transferred in the first unit 10Y, sequentially passes through the second to fourth units 10M, 10C, and 10K and toner images of the respective colors are transferred and layered.

The intermediate transfer belt 20, onto which multi-layer four color toner images are transferred by the first to fourth units, arrives at a secondary transfer portion which includes the intermediate transfer belt 20, the supporting roller 24 in contact with the inside of the intermediate transfer belt 20, and a secondary transfer roller (secondary transfer unit) 26 disposed on the image holding surface side of the intermediate transfer belt 20. Meanwhile, a recording paper (transfer medium) P is supplied to a nip portion between a secondary transfer roller 25 and the intermediate transfer belt 20 by a supply mechanism at a predetermined timing and a predetermined secondary transfer bias is applied to the supporting roller 24. The transfer bias applied at this time has negative polarity, which is the same polarity as the toner. Electrostatic force is applied to the multi-layer toner images in a direction from the intermediate transfer belt 20 to the recording paper P and the multi-layer toner it images on the intermediate transfer belt 20 are transferred onto the recording paper P. The secondary transfer bias is determined and controlled according to resistance detected by a resistance detection unit not shown) which detects the resistance of the secondary transfer portion.

Next, the recording paper P is transported to a fixing device (fixing unit) 28. The multi-layer color toner images are heated and melted; and fixed on the recording paper P. The recording paper P on which the color images are fixed is transported toward a discharge portion by a feed roll (discharge roll) 32 and a series of color image forming operations are finished.

In the above-described example of the image forming apparatus, the multi-layer toner images are transferred onto the recording paper P through the intermediate transfer belt 20, but the exemplary embodiment is not limited to this configuration. Toner images may be directly transferred onto a recording medium from a photoreceptor.

Process Cartridge and Toner Cartridge

Figure 2:
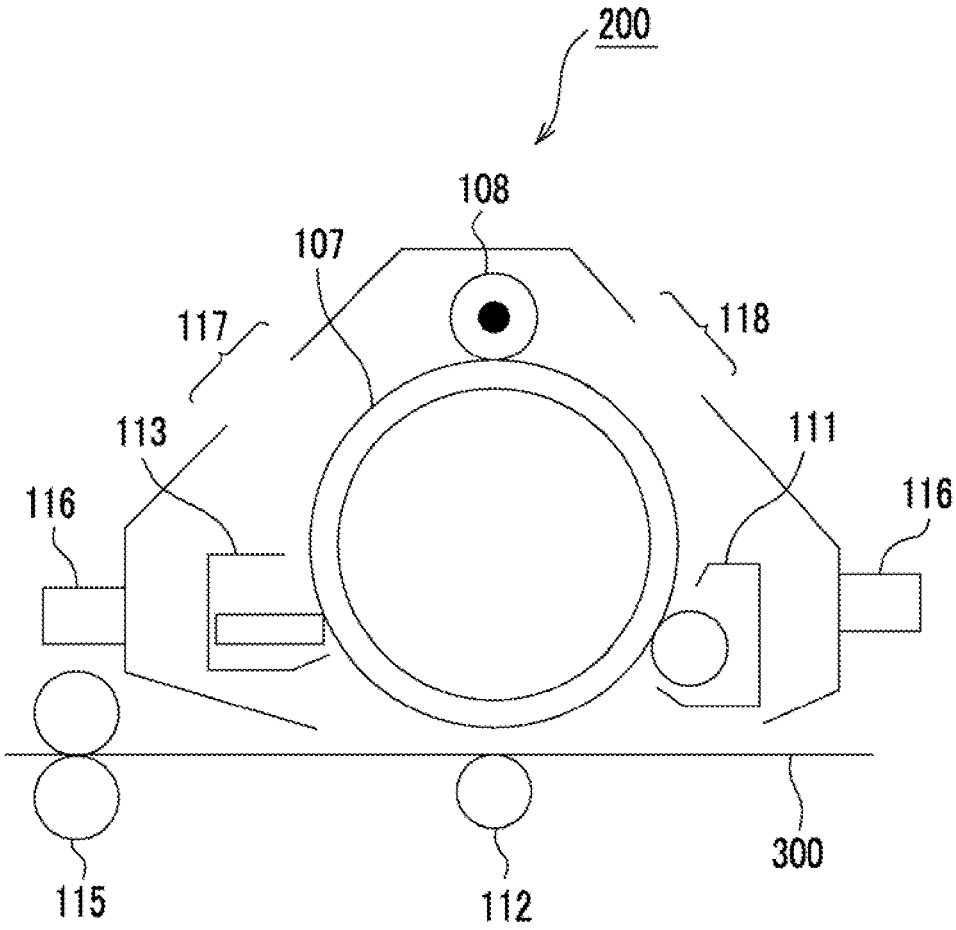
FIG. 2 is a diagram schematically illustrating a configuration example of a process cartridge according to an exemplary embodiment of the invention.

FIG. 2 is a diagram schematically illustrating a preferable configuration example of a process cartridge which contains the developer according to an exemplary embodiment. In a process cartridge 200, a photoreceptor 107, a charging roller 108, a developing device 111, a photoreceptor cleaning device (cleaning unit) 113, an opening 118 for exposure, and an opening 117 for erasing and exposure are combined and integrated through a mounting rail 116.

This process cartridge 200 is detachable from an image forming apparatus which includes a transfer device 112, a fixing device 115, and other components (not shown) and configures an image forming apparatus with an image forming apparatus main body. In addition, reference numeral 300 represents a recording medium.

The process cartridge 200 shown in FIG. 2 includes a photoreceptor 107, the charging roller 108, the developing device 111 the photoreceptor cleaning device 113, the opening 118 for exposure, and the opening 117 for erasing and exposure, but these components may be selectively combined. The process cartridge according to the exemplary, embodiment includes the developing device 111 and at least one kind selected from a group consisting of the photoreceptor 107, the charging roller 108, the photoreceptor cleaning device (cleaning unit) 113, the opening 118 for exposure, and the opening 117 for erasing and exposure.

Next, a toner cartridge according to the exemplary embodiment will be described.

The toner cartridge is detachable from an image forming apparatus and accommodates at least a toner which is supplied to a developing unit provided inside an image forming apparatus, in which the toner is the toner according to the exemplary embodiment. The toner cartridge accommodates at least toner and may accommodate, for example, a developer, depending on the mechanism of an image forming apparatus.

In FIG. 1, the toner cartridges 8Y, 8M, 8C, and 8K are detachable from the image forming apparatus and the developing devices 4Y, 4M, 4C, and 4K are connected to the toner cartridges corresponding to the respective developing devices (colors) through developer supply tubes (not shown). In addition, when the amount of developer accommodated in a toner cartridge is small, this toner cartridge may be replaced with another one.

EXAMPLES

Hereinafter, the exemplary embodiment will be described in detail with reference to Examples, but the exemplary embodiment is not limited to Examples below. In addition, unless specified otherwise, "part" and "%" represent "part by weight" and "% by weight".

Measurement Method of Various Physical Properties

Measurement of Softening Temperature

The softening temperature is measured using a constant-load orifice-type flow tester CFT-500 (manufactured by Shimadzu Corporation) as a temperature which corresponds to a half of the height between a flow start point and a flow end point when a 1 $cm^3$-sized sample is melted and caused to flow out under conditions of a die pore diameter of 0.5 mm, a pressing load of 0.98 MPa (10 $Kg/cm^2$), and a rate of temperature rise of 1° C./min.

Measurement of Melting Temperature

The glass transition temperature is measured using "DSC-20" (manufactured by SEICO Electronics) and 10 mg of sample is heated at a rate of temperature rise (10'Cimin) for measurement.

Measurement of Weight Average Molecular Weight Mw and Number Average Molecular Weight Mn Two of "HLC-8120 GPC, SC-8020 (manufactured by Tosoh Corporation, 6.0 mm ID×15 cm)" are used and tetrahydrofuran (THF) is used as an eluent. The test is conducted using a RI detector under the following conditions: a sample concentration of 0.5%; a flow rate of 0.6 ml/min; a sample injection amount of 10 μl; and a measurement temperature of 40° C.

In addition, a calibration curve is prepared from ten "polystyrene standard samples, TSK standard" "A-500", "F-1" "F-10", "F-80", "F-380", "A-2500", "F-4", "F-40", "F-128", and F-700" (manufactured by Tosoh Corporation).

Measurement of Acid Value

The acid value is measured using neutralization analysis according to JIS K0070. That is, an appropriate amount of sample is split and 100 ml of solvent (mixed solution of diethyl ether and ethanol) and several drops of indicator (phenolphthalein solution) are added thereto, followed by shaking and mixing in a cold bath until the sample i is completely dissolved. The solution is titrated with 0.1 mol/l of ethanolic potassium hydroxide solution. The measurement ends when the indicator maintains a light pink color for 30 seconds. When A represents the acid value, S(g) represents the sample amount, B(ml) represents 0.1 mol/l of ethanolic potassium hydroxide solution, and f represents factor of 0.1 mol/l of ethanolic potassium hydroxide solution, the acid value is calculated through an expression of $A=(B\times f\times 5.611)/S$.

Preparation of Aliphatic Polyester Resin A (Resin A)

46 parts of sebacic acid, 45 parts of 1,3-propanediol, and 0.2% by mole of dibutyltin oxide are put into a 1 L three-necked flask in a polycondensation device which is equipped with a stirring device, a thermometer, and a cooling pipe, followed by polycondensation under reduced pressure at 140° C. After 8 hours, when physical properties are measured, the molecular weight Mw is 27,000 and the melting temperature is 83° C.

In this case, the addition amount of dibutyltin oxide is an addition amount with respect to the total olar number of polymerizable monomers (sebacic acid and 1,3-propanediol).

Preparation of Aliphatic Polyester Resin B (Resin B)

63 parts of dodecanedioic acid, 21 parts of 1,6-hexanediol, and 0.2% by mole of dodecylbenzenesulfonic acid are put into a 1 L three-necked flask in a polycondensation device which is equipped with a stirrer, a thermometer, and a cooling pipe, followed by polycondensation under reduced pressure at 150° C. After 8 hours, when physical properties are measured, the molecular weight Mw is 35,000 and the melting temperature is 75° C.

In this case, the addition amount of dodecylbenzenesulfonic acid is an addition amount with respect to the total molar number of polymerizable monomers (dodecanedioic acid and 1,6-hexanediol).

Preparation of Specific Rosin-Based Polyester Resin C (Resin C)

Synthesis of Specific Rosin Dial (1)

120 g of bisphenol A diglycidyl ether (trade name: jER828, manufactured by Mitsubishi Chemical Corporation), 250 g of rosin, which is purified by distillation, as a rosin component, and tetraethylammonium bromide as a catalyst are put into a stainless steel reaction vessel, which is equipped with a stirring device, a heating device, a cooling pipe, and a thermometer, and heated to 140° C. Then, a carboxyl group of the rosin and an epoxy group of the epoxy compound are caused to react with each other, thereby carrying out the ring-opening reaction of an epoxy ring. The reaction is carried out at the same temperature for 4 hours and stopped when the acid value reaches 0.5 mg KOH/g. As a result, Specific rosin diol (1) is obtained.

Synthesis of Resin C 300 g of Specific rosin dial (1) as a diol component, 38 g of terephthalic acid as a dicarboxylic acid component, 24 g of isophthalic acid, 0.3 g of dibutyltin oxide as a catalyst are put into a stainless steel reaction vessel, which is equipped with a stirring device, a heating device, a thermometer, a fractionator, and a nitrogen gas inlet pipe, followed by polycondensation in a nitrogen atmosphere under stirring at 240° C. for 7 hours. It is confirmed that Mw reaches 27,000 and the acid value reaches 15.1 mg/KOH and Resin C is synthesized. 2 g of Resin C thus synthesized is heated in 10 ml of heavy dimethylsulfoxide and 2 ml of heavy methanol solution (7N) of sodium hydroxide at 150° C. for 3 hours and hydrolyzed. Then, heavy water is added thereto, $^{1}$H-NMR measurement is conducted, and it is confirmed that Resin C is composed of specific rosin diol (1), terephthalic acid and isophthalic acid as charged.

Synthesis of Comparative Rosin-Based Polyester Resin D (Resin D)

40 parts of ethylene oxide 2 mole adducts of bisphenol A and 215 parts of propylene oxide 2 mole adducts of bisphenol A as diol components; 40 parts of dimethyl terephthalate, 19 parts of trimellitic anhydride, and 25 parts of maleic acid-modified rosin as a dicarboxylic acid components; and 0.2 parts of tetra-n-butyl titanate as a catalyst are put into a stainless steel reaction vessel, which is equipped with a stirring device, a heating device, a cooling pipe, and a thermometer, followed by polycondensation in a nitrogen atmosphere under stirring at 230° C. for 7 hours. As a result, Resin D is obtained. When the physical properties of Resin D is measured, Tg is 52° C. Mw is 15,000, and the acid value is 21 mg KOH/g.

Preparation of Specific Rosin-Based Polyester Resin E (Resin E)

Synthesis of Specific Rosin Diol (2)

77 parts of 1,6-hexanediol diglycidyl ether (trade name: EX-212, manufactured by Nagase ChemteX Corporation) as a bifunctional epoxy compound; 200 parts of disproportionated rosin (trade name: Pine Crystal KR614, manufactured by Arakawa Chemical Industries, Ltd.) as a rosin component; and 1.5 parts of tetraethylammonium bromide (manufactured by TOKYO CHEMICAL INDUSTRY CO., LTD.) as a catalyst are put into a stainless steel reaction vessel, which is equipped with a stirring device, a heating device, a cooling pipe, and a thermometer, and heated to 130° C. Then, a ring-opening reaction of an acid group of the rosin and an epoxy group of the epoxy compound are carried out. The reaction is carried out at the same temperature for 5 hours and stopped when the acid value reaches 0.5 mg KOH/g. As a result, Specific rosin diol (2) is obtained.

Synthesis of Resin E

Resin E (Mw: 34,000, acid value: 10.5 g/KOH) is synthesized in the same synthesis method as that of Resin C, except that Specific rosin diol (2) is used instead of Specific resin diol (1).

Preparation of Aliphatic Polyester Resin F (Resin F)

Aliphatic polyester resin F (Resin F) is prepared in the same preparation method of Aliphatic polyester resin A (Resin A), except that decanediol is used instead of 1,3-propanediol.

Preparation of Aliphatic Polyester Resin G (Resin G)

Aliphatic polyester resin G (Resin G) is prepared in the same preparation method of Aliphatic polyester resin B (Resin B), except that octadecanediol is used instead 1,6-hexanediol.

Repeating Unit of Aliphatic Polyester Resin

With regard to Aliphatic Polyester Resin A, Aliphatic Polyester Resin B, Aliphatic Polyester Resin F and Aliphatic Polyester Resin G, the sum of the numbers of carbon atoms of A and B in the repeating unit represented by Formula (I) is shown in Item "Number of Carbon Atom" of "(1) Aliphatic Polyester" in Table 1.

Preparation of Resin Particle Dispersion (a) using Resin A 0.5 parts of soft type sodium dodecylbenzenesulfonate as a surfactant is added to 100 parts of Resin A and 300 parts of ion exchange water is further added thereto. The resultant is sufficiently mixed and dispersed in a round glass flask using a homogenizer (manufactured by TKA Japan K.K, ULTRA-TURRAX T50) while being heated to 80° C. Then, using 0.5 mole/liter aqueous sodium hydroxide, the pH value in the system is adjusted to 5.0. The resultant is heated to 95° C. while stirring using the homogenizer is continued. As a result, Resin particle Dispersion (a) having resin particles with an average particle size of 250 nm and a solid content of 20% is obtained.

Preparation of Resin Particle Dispersion (b) Using Resin B

Resin particle Dispersion (b) using Resin B is prepared the same preparation method as that of Resin particle dispersion (a), except that Resin A is changed to Resin B.

Preparation of Resin Particle Dispersion (c) Using Resin C 0.5 parts of soft type sodium dodecylbenzenesulfonate as a surfactant is added to 100 parts of Resin C and 300 parts of ion exchange water is further added thereto. The resultant is sufficiently mixed and dispersed in a round glass flask using a homogenizer (manufactured by IKA Japan K.K, ULTRA-TURRAX T50) while being heated to 80° C. Then, using 0.5 mole/liter aqueous sodium hydroxide, the pH value in the system is adjusted to 5.0. The resultant is heated to 98° C. while stirring using the homogenizer is continued. As a result, an emulsified dispersion of Resin C is obtained. Resin particle dispersion (c) having resin particles with an average particle size of 168 nm and a solid content of 20% is obtained, Preparation of Resin Particle Dispersion (d) Using Resin D 0.5 parts of soft type sodium dodecylbenzenesulfonate as a surfactant is added to 100 parts of Resin D and 300 parts of ion exchange water is further added thereto. The resultant is sufficiently mixed and dispersed in a round glass flask using a homogenizer (manufactured by IKA Japan K.K, ULTRA-TURRAX T50) while being heated to 80° C. Then, using 0.5 mole/liter aqueous sodium hydroxide, the pH value in the system is adjusted to 5.0. The resultant is heated to 92° C. while stirring using the homogenizer is continued. As a result, an emulsified dispersion of Resin D is obtained. Resin particle dispersion (d) having resin particles with an average particle size of 125 nm and a solid content of 20% is obtained.

Preparation of Resin Particle Dispersion (e) Using Resin E

Resin particle dispersion (e) using Resin E is prepared in the same preparation method as that of Resin particle dispersion (c), except that Resin C is changed to Resin E.

Preparation of Resin Particle Dispersion (f) Using Resin F

Resin Particle Dispersion (f) using Resin F is prepared in the same preparation method as that of Resin particle dispersion (a), except that Resin A is changed to Resin F.

Preparation of Resin Particle Dispersion (g) Using Resin G

Resin particle dispersion (g) using Resin G is prepared in the same preparation method as that of Resin particle dispersion (a), except that Resin A is changed to Resin G.

Preparation of Colorant Particle Dispersion (P1)

Cyan pigment (manufactured by Dainichiseika Color & Chemicals Mfg. Co., Ltd., copper phthalocyanine C.I. Pigment Blue 15:3) 50 parts Anionic surfactant (manufactured by DAI-ICHI KOGYO SEIYAKU CO., LTD., NEOGEN R): 5 parts Ion exchange water: 200 parts The above components are mixed and dissolved, and dispersed for 5 minutes using a homogenizer (manufactured by IKA Japan K.K, ULTRA-TURRAX) and dispersed for 10 minutes in an ultrasonic bath. As a result, Colorant particle dispersion (P1) having colorant particles with an average particle size of 190 nm and a solid content of 20% is obtained.

Preparation of Release Agent Particle Dispersion (W1)

Dodecyl sulfate: 30 parts

Ion exchange water: 852 parts

The above components are mixed and an aqueous dodecyl sulfate solution is prepared.

Palmitac acid: 188 parts

Pentaerythritol: 25 parts

In addition to the aqueous dodecyl sulfate solution, the above components are mixed, heated to 250° C. and dissolved. Then, the resultant is added to the aqueous dodecyl sulfate solution, emulsified for 5 minutes using a homogenizer (manufactured by IKA Japan K.K, ULTRA-TURRAX), and further emulsified for 15 minutes in an ultrasonic bath. The emulsion is put into a flask and held at 70° C. for 15 hours under stirring.

As a result, Releasing agent particle dispersion (W1) having releasing agent particles with an average particle size of 200 nm, a melting temperature of 72° C. and a solid content of 20% is obtained.

Example 1

Preparation of Toner Particles (1)

Resin particle dispersion (a): 100 parts (Content of Resin A: 20 parts)

Resin particle dispersion (c): 300 parts (Content of Resin C: 60 parts)

Colorant particle dispersion (P1): 50 parts (Content Pigment: 10 parts)

Releasing agent particle dispersion W1): 50 parts (Content of Release Agent: 10 parts)

Polyaluminum chloride: 0.15 parts

Ion exchange water: 300 parts

The above components are put into a round stainless steel flask, mixed and dispersed using a homogenizer (manufactured by TKA. Japan K.K, ULTRA-TURRAX T50), heated to 42° C. in a heating oil bath under stirring, and held at 42° C. for 60 minutes.

Then, using 0.5 mole/liter aqueous sodium hydroxide, the pH value in the system is adjusted to 6.0. The resultant is heated to 95° C. while stirring is continued. In general, while the resultant is heated to 95° C., the pH value in the system is reduced to 5.0 or lower. However, in this example, by adding the aqueous sodium hydroxide dropwise, the pH value is maintained to be higher than 5.5.

After the reaction is stopped, the resultant is cooled and filtrated. The filtrate is sufficiently washed with ion exchange water, followed by solid-liquid separation with a Nutsche vacuum filter. Then, the resultant is dispersed again in 3 liters of ion exchange water at 40° C., stirred for 15 minutes at 300 rpm, and washed. The above process is repeated five times, followed by solid-liquid separation with a Nutsche vacuum filter and vacuum drying for 12 hours. As a result, Toner particles (1) are obtained.

When the volume average particle size of Toner particles (1) is measured using a Coulter counter, the cumulative volume average particle size $D_{50}$ is 5.8 μm and the volume average particle size distribution index $GSD_v$ is 1.24. In addition, the shape factor SF1 of Toner particles (1) which is obtained by observing the shape through a Luzex image analyzer, is 130 and Toner particles (1) have a potato shape.

Preparation of External Additive-Added Toner (1) and Developer (1)

1.5 parts of hydrophobic silica (manufactured by Cabot Corporation, TS720) is added with respect to 50 parts of Toner particles (1) and mixed using a sample mill. As a result, External additive-added toner obtained.

A carrier, which is formed of ferrite particles with a particle size of 50 μm 1% of which are coated with polymethyl methacrylate (manufactured by Soken Chemical & Engineering Co., Ltd., Mw: 75,000); and External additive-added toner 1 are added such that the concentration of the toner is 5%. They are stirred and mixed using a ball mill for 5 minutes. As a result, Developer (1) is prepared.

Evaluation of Toner

When measured using a flow tester (CFT-500A, manufactured by Shimadzu Corporation), the softening temperature of External additive-added toner (1) is 125° C.

Evaluation of Biodegradability of Toner

Using External additive-added toner (1) Plate (1) with a thickness of 3 mm is prepared at a temperature 15° C. higher than the softening temperature of External additive-added toner (1). Then, biodegradability and the following physical properties are evaluated. The results are shown in Table 1.

Biodegradability

The biodegradability is evaluated as follows. Plate (1) is cut out to a 10 $cm^2$ size and buried in a relatively-high-humidity (unsunny) soil (with a depth of 15 cm from the surface) having a moisture content of 50% or greater. In addition, similarly, in a relatively sunny and low-humidity soil (with a depth of 7 cm from the surface), Plate (1) is buried. Then, after 6 months and after 12 months from the burial, the structures of the plates are visually inspected. The evaluation is performed based on the following evaluation criteria.

Evaluation Criteria

A: Most portions (65% or greater) of the structure of the plate are lost

B: Half portions (from 45% to 65%) of the structure of h plate are lost

C: Almost entire portions (45% or less) of the structure of the plate remain.

Evaluation of Mechanical Strength of Toner (Developer)

The mechanical strength of External additive-added toner (1) is evaluated in an environment where: an image forming apparatus, in which a fixing device of 700 Digital Color Press manufactured by Fuji Xerox co., Ltd.) is modified, is used; as a recording medium, Miller Coat Platinum Paper (thick coated paper authorized by Fuji Xerox Co., Ltd.; 127 $g/m^2$) is used; and the process speed is adjusted to 180 mm/sec. The results thereof are shown in Table 1.

The toner is held in a high-temperature chamber (50° C.) for 17 hours.

The toner is taken out from the chamber and a developer is prepared.

Next, a developing unit of a full-color copying machine 700 Digital Color Press (manufactured by Fuji Xerox co. Ltd.) is made to be driven as a single unit, the developer is put into the developing unit, and the developing unit is driven under the same conditions of the inside of the copying machine. Therefore, for a random time (2 hours or more), the developer in the developing unit is sampled, the particle size distribution of the toner is measured using a Coulter counter TAII (manufactured by Nikkaki Corporation). In a graph in which the X axis represents a driving time and the Y axis represents a number average particle size distribution, a cumulative value of particles having a particle size of 3.0 μm or less is plotted and the gradient thereof is defined as a mechanical strength index. The greater the numerical value thereof, the more easily fracture in the developing unit is generated, which means that the mechanical strength is weak. Based on the obtained mechanical strength index, the mechanical strength is evaluated according to the following evaluation criteria.

Evaluation Criteria

A: The mechanical strength index is less than 0.12

B: The mechanical strength index is equal to or greater than 0.12 and less than 0.15

C: The mechanical strength index is equal to or greater than 0.15

When evaluated in the above-described evaluation method, the fixing property of External Additive-added toner (1) is satisfactory. In addition, the minimum fixing temperature is 120° C. and an image has a sufficient fixing property and uniform gloss. A high-quality image (A) with satisfactory developability and transfer characteristics and without image defects is obtained.

Even at a fixing temperature of 200° C., hot offset does not occur.

In addition, in the modified machine, a test of continuously printing 50,000 images is conducted in a laboratory environment. Satisfactory quality in the initial stage is maintained to the end. (Maintainability in Continuous Tests: A)

Example 2

Preparation of Toner Particles (2)

Toner particles (2) are obtained in the same preparation method as that of Toner particles (1), except that Resin particle dispersion (b) is used instead of Resin particle dispersion (a).

When the volume average particle size of Toner particles (2) is measured using a Coulter counter, the cumulative volume average particle size $D_{50}$ is 5.5 μm and the volume to average particle size distribution index $GSD_v$ is 1.21. In addition, the shape factor SF1 of Toner particles (2), which is obtained by observing the shape through a Luzex image analyzer, is 136.

Preparation of External Additive-Added Toner (2) and Developer (2)

External additive-added toner (2) and Developer (2) of Example 2 are prepared in the same preparation methods as those of External additive-added toner (1) and Developer (1) of Example 1, except that Toner particles (2) are used instead of Toner particles (1).

In addition, when measured in the same measurement method as that of Example 1, the softening temperature of External additive-added toner (2) is 121° C.

With regard to External additive-added toner (2) and Developer (2) thus obtained, the evaluation is carried out in the same evaluation method of Example 1.

The results are shown in Table 1.

Example 3

External additive-added toner (3) of Example 3 is prepared in the same preparation method as those of External additive-added toner (1) of Example 1, except that Resin particle dispersion (a) and Resin particle dispersion (c) are mixed such that the weight ratio of Resin A and Resin C matches that shown in Item "Weight Ratio of (1)/(2)" of Table 1. The softening temperature of External additive-added toner (3) is measured in the same measurement method as that of External additive-added toner (1) and the result thereof is shown in Table 1.

In addition, Developer (3) is prepared in the same preparation method as that of Developer (1), except that External additive-added toner (3) is used instead of External additive-added toner (1).

With regard to External additive-added toner (3) and Developer (3) thus obtained, the evaluation is carried out in the same evaluation method of Example 1. The results are shown in Table 1.

Example 4

External additive-added toner (4) of Example 4 is prepared in the same preparation method as those of External additive-added toner (1) of Example 1, except that Resin particle dispersion (a) and Resin particle dispersion (c) are mixed such that the weight ratio of Resin A and Resin C matches that shown in. Item "Weight Ratio of (1)/(2)" of Table 1. The softening temperature of External additive-added toner (4) is measured in the same measurement method as that of External additive-added toner (1) and the result thereof is shown in Table 1.

In addition, Developer (4) is prepared in the same preparation method as that of Developer (I), except that External additive-added toner (4) is used instead of External additive-added toner (1).

With regard to External additive-added toner (4) and Developer (4) thus obtained, the evaluation is carried out in the same evaluation method of Example 1. The results are shown in Table 1

Example 5

External additive-added toner (5) of Example 5 is prepared in the same preparation method as those of External additive-added toner (2) of Example 2, except that Resin particle dispersion (b) and Resin particle dispersion (c) are mixed such that the weight ratio of Resin B and Resin C matches that shown in Item "Weight Ratio of (1)/(2)" of Table 1. The softening temperature of External additive-added toner (5) is measured in the same measurement method as that of External additive-added toner (1) and the result thereof is shown in Table 1.

In addition, Developer (5) is prepared in the same preparation method as that of Developer (1), except that External additive-added toner (5) is used instead of External additive-added toner (1).

With regard to External additive-added toner (5) and Developer (5) thus obtained, the evaluation is carried out in the same evaluation method of Example 1. The results are shown in Table 1.

Example 6

External additive-added toner (6) of Example 6 is prepared in the same preparation method as those of External additive-added toner (2) of Example 2, except that Resin particle dispersion (b) and Resin particle dispersion (c) are mixed such that the weight ratio of Resin B and Resin C matches that shown in Item "Weight Ratio of (1)/(2)" of Table 1. The softening temperature of External additive-added toner (6) is measured in the same measurement method as that of External additive-added toner (1) and the result thereof is shown in Table 1.

In addition, Developer (6) is prepared in the same preparation method as that of Developer (1), except that External additive-added toner (5) is used instead of External additive-added toner (1).

With regard to External additive-added toner (6) and Developer (6) thus obtained, the evaluation is carried out in the same evaluation method of Example 1. The results are shown in Table 1.

Example 7

Preparation of Toner Particles (7)

Toner particles (7) are obtained in the same preparation method as that of Toner particles (1), except that Resin particle dispersion (e) is used instead of Resin particle dispersion (a).

When the volume average particle size of Toner particles (7) is measured using a Coulter counter, the cumulative volume average particle size $D_{50}$ is 5.9 μm and the volume average particle size distribution index $GSD_v$ is 1.19. In addition, the shape factor SP1 of Toner particles (7), which is obtained by observing the shape through a Luzex image analyzer, is 128.

Preparation of External Additive-Added Toner (7) and Developer (7)

External additive-added toner (7) and Developer (7) of Example 7 are prepared in the same preparation methods as those of External additive-added toner (1) and Developer (1) of Example 1, except that Toner particles (7) are used instead of Toner particles (1).

In addition, the softening temperature of External additive-added toner (7) is measured in the same measurement method as that of Example 1. The result is shown in Table 1.

With regard to External additive-added toner (7) and Developer (7) thus obtained, the evaluation is carried out in the same evaluation method of Example 1.

The results are shown in Table 1.

Example 8

Preparation of Toner Particles (8)

Toner particles (8) are obtained in the same preparation method as that of Toner particles (1), except that Resin particle dispersion (f) is used instead of Resin particle dispersion (a).

Preparation of External Additive-Added Toner (8) and Developer (8)

External additive-added toner (8) and Developer (8) of Example 8 are prepared in the same preparation methods as those of External additive-added toner (1) and Developer (1) of Example 1, except that Toner particles (8) are used instead of Toner particles (1).

With regard to External additive-added toner (8) and Developer (8) thus obtained, the evaluation is carried out in the same evaluation method of Example 1.

The result are shown in Table 1.

Example 9

Preparation of Toner Particles (9)

Tuner particles (9) are obtained in the same preparation method as that of Toner particles (1), except that Resin particle dispersion (g) is used instead of Resin particle dispersion (a).

Preparation of External Additive-Added Toner (9) and Developer (9)

External additive-added toner (9) and Developer (9) of Example 9 are prepared in the same preparation methods as those of External additive-added toner (1) and Developer (1) of Example 1, except that Toner particles (9) are used instead of Toner particles (1).

With regard to External additive-added toner (9) and Developer (9) thus obtained, the evaluation is carried out in the same evaluation method of Example 1.

The results are shown in Table 1.

Comparative Example 1

Preparation of Toner Particles (101)

Resin particle dispersion (a): 100 parts (Content of Resin A: 20 parts)

Resin particle dispersion (d): 300 parts (Content of Resin D: 60 parts)

Colorant particle dispersion (P1): 50 parts (Content of Pigment: 10 parts)

Releasing agent particle dispersion (W1): 50 parts (Content of Release Agent: 10 parts)

Polyaluminum chloride: 0.15 parts

Ion exchange water: 300 parts

Toner particles (101) of Comparative Example 1 are prepared in the same preparation method as that of Toner particles (1), except that the composition of Toner particles (1) is changed to the above composition.

When the volume average particle size of Toner particles (101) is measured using a Coulter counter, the cumulative volume average particle size $D_{50}$ is 7.6 μm and the volume average particle size distribution index $GSD_v$ is 1.29. In addition, the shape factor SF1 of Toner particles (101), which is obtained by observing the shape through a Luzex image analyzer, is 136.

Preparation of External Additive-Added Toner (101) and Developer (101)

External additive-added toner (101) and Developer (101) of Comparative Example 1 are prepared in the same preparation methods as those of External additive-added toner (1) and Developer (1) of Example 1, except that Toner particles (101) are used instead of Toner particles (1).

In addition, when measured in the same measurement method as that of Example 1, the softening temperature of External additive-added toner (101) is 131° C.

With regard to External additive-added toner (101) and Developer (101) thus obtained, the evaluation is carried out in the same evaluation method of Example 1.

The results are shown in Table 1.

Comparative Example 2

External additive-added toner (102) of Comparative Example 2 is prepared in the same preparation method as those of External additive-added toner (101) of Comparative. Example 1, except that Resin particle dispersion (a) and Resin particle dispersion (d) are mixed such that the weight ratio of Resin A and Resin D matches that shown in Item "Weight. Ratio of (1)/(2)" of Table 1. The softening temperature of External additive-added toner (102) is measured in the same measurement method as that of External additive-added toner (1) and the result thereof is shown in Table 1.

In addition, Developer (102) is prepared in the same preparation method as that of Developer (1), except that External additive-added toner (102) is used instead of External additive-added toner (1).

With regard to External additive-added toner (102) and Developer (102) thus obtained, the evaluation is carried out in the same evaluation method of Example 1. The results are shorn in Table 1.

Comparative Example 3

Preparation of Toner Particles (103)

Resin particle dispersion (a): 320 parts (Content of Resin A: 64 parts)

Colorant particle dispersion (P1) 50 parts (Content of Pigment: 10 parts)

Releasing agent particle dispersion W1): 50 parts (Content of Release Agent: 10 parts)

Polyaluminum chloride: 0.15 parts

Ion exchange water: 300 parts

Toner particles (103) of Comparative Example 3 are prepared in the same preparation method as that of Toner particles (1) of Example 1, except that the composition of Toner particles (1) is changed to the above composition.

When the volume average particle size of Toner particles (103) is measured using a Coulter counter, the cumulative volume average particle size $D_{50}$ is 6.2 μm and the volume average particle size distribution index $GSD_v$ is 1.21. In addition, the shape factor SF1 of Toner particles (103), which is obtained by observing the shape through a Luzex image analyzer, is 128.

Preparation of External Additive-Added Toner (103) and Developer (103)

External additive-added toner (103) and Developer (103) of Comparative Example 3 are prepared in the same preparation methods as those of External additive-added toner (1) and Developer (1) of Example 1, except that Toner particles (103) are used instead of Toner particles (1).

In addition, when measured in the same measurement method as that of Example 1, the softening temperature of External additive-added toner (103) is 142° C.

With regard to External additive-added toner (103) and Developer (103) thus obtained, the evaluation is carried out in the same evaluation method of Example 1

The results are shown in Table 1.

Comparative Example 4

Preparation of Toner Particles (104)

Toner particles (104) are obtained in the same preparation method as that of Toner particles (103) except that Resin particle dispersion (d) is used instead of Resin particle dispersion (a).

When the volume average particle size of Toner particles (104) is measured using a Coulter counter, the cumulative volume average particle size $D_{50}$ is 7.9 μm and the volume average particle size distribution index $GSD_v$ is 1.35. In addition, the shape factor SF1 of Toner particles (104), which is obtained by observing the shape through a Luzex image analyzer, is 148.

Preparation of External Additive-Added Toner (104) and Developer (104)

External additive-added toner (104) and Developer (104) of Comparative Example 4 are prepared in the same preparation methods as those of External additive-added toner (1) and Developer (1) of Example 1, except that Toner particles (104) are used instead of Toner particles (1).

In addition, the softening temperature of External additive-added toner (104) is measured in the same measurement method as that of External additive-added toner (1) and the result thereof is shorn Table 1.

With regard to External additive added toner (104) and Developer (104) thus obtained, the evaluation is carried out in the same evaluation method of Example 1.

The results are shown in Table 1.

TABLE 1

| | Toner Configuration | | | | Evaluation | | | | |
|---|---|---|---|---|---|---|---|---|---|
| | (1) Aliphatic Polyester | | (2) Specific Rosin-Based Polyester | Weight Ratio of | Biodegradability | | | | Strength of Toner |
| | | | | | High Humidity | | Low Humidity | | |
| | Kind | Number of Carbon Atoms | Kind | (1)/(2) | 6 months | 12 months | 6 months | 12 months | |
| Example 1 | Resin A | 11 | Resin C | 25/75 | A | A | A | A | A |
| Example 2 | Resin B | 16 | Resin C | 25/75 | A | A | A | A | A |
| Example 3 | Resin A | 11 | Resin C | 5/95 | A | A | A | A | A |
| Example 4 | Resin A | 11 | Resin C | 35/65 | A | A | A | A | A |
| Example 5 | Resin B | 16 | Resin C | 50/50 | A | A | B | A | A |
| Example 6 | Resin B | 16 | Resin C | 35/65 | A | A | B | A | A |
| Example 7 | Resin A | 11 | Resin E | 25/75 | A | A | A | A | B |
| Example 8 | Resin F | 21 | Resin C | 25/75 | A | A | A | A | A |
| Example 9 | Resin G | 28 | Resin C | 25/75 | B | A | B | B | A |
| Comparative Example 1 | Resin A | 11 | Resin D | 25/75 | C | B | B | B | A |
| Comparative Example 2 | Resin A | 11 | Resin D | 10/90 | C | B | C | C | A |
| Comparative Example 3 | Resin A | 11 | None | 100/0 | B | A | A | A | C |
| Comparative Example 4 | None | — | Resin D | 0/100 | C | C | C | C | A |

As seen from Table 1, when External additive-added toners and Developers of Examples 1 to 9 are used, both of biodegradability and the strength of the toner may be satisfactory at the same time and an image with less environmental impact may be formed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner for developing an electrostatic charge image comprising:

an aliphatic polyester resin; and a polyester resin including a repeating unit derived from rosin diol, the polyester resin being a polycondensate of rosin diol represented by Formula (II) and dicarboxylic acid:

(II)

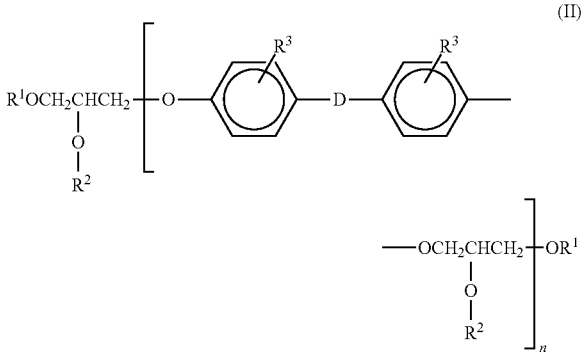

wherein in Formula (II), $R^1$ represents a stabilized rosin residue or two kinds of groups including a stabilized rosin residue and a monobasic acid group, n represents an integer of 1 to 6, where when n represents 1, $R^2$ represents a hydrogen atom, and when n represents 2 or more, two of the $R^2$s represent a hydrogen atom and the other $R^2$s represent an acetoacetyl group or two or more kinds of groups including an acetoacetyl group and at least one monobasic acid group, $R^3$ represents at least one kind selected from a hydrogen atom and a halogen atom, and D represents a methylene group or an isopropylene group.

2. The toner for developing an electrostatic charge image according to claim 1, wherein the aliphatic polyester resin comprises a repeating unit represented by Formula (I):

(I)

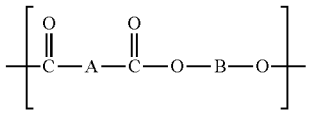

wherein in Formula (I),

A represents a single bond or a divalent aliphatic hydrocarbon group,

B represents a divalent aliphatic hydrocarbon group having two or more carbon atoms, and a sum of the numbers of carbon atoms of A and B is from 2 to 25.

3. The toner for developing an electrostatic charge image according to claim 1, wherein a content ratio of the aliphatic polyester resin to the polyester resin including a repeating unit derived from rosin diol is from 5/95 to 40/60 in terms of weight.

4. The toner for developing an electrostatic charge image according to claim 2, wherein a content ratio of the aliphatic polyester resin to the polyester resin including a repeating unit derived from rosin diol is from 5/95 to 40/60 in terms of weight.

5. An electrostatic charge image developer comprising the toner for developing an electrostatic charge image according to claim 1.

6. A toner cartridge which is detachable from an image forming apparatus and contains the toner for developing an electrostatic charge image according to claim 1.

7. A process cartridge which is detachable from an image forming apparatus and contains the electrostatic charge image developer according to claim 5, comprising a developing unit that forms a toner image by developing an electrostatic latent image, which is formed on a surface of a latent image holding member, using the electrostatic charge image developer.

8. An image forming apparatus comprising:

a latent image holding member;

a charging unit that charges a surface of the latent image holding member;

an electrostatic latent image forming unit that forms an electrostatic latent image on the surface of the latent image holding member;

a developing unit that contains a developer and forms a toner image by developing the electrostatic latent image using the developer;

a transfer unit that transfers the toner image onto a recording medium; and a fixing unit that fixes the toner image on the recording medium, wherein the developer is the electrostatic charge image developer according to claim 5.

* * * * *